US010398190B2

(12) United States Patent
Farris

(10) Patent No.: US 10,398,190 B2
(45) Date of Patent: Sep. 3, 2019

(54) ARTICLE OF FOOTWEAR INCLUDING PORTIONS CONFIGURED FOR CUSTOMIZATION

(71) Applicant: NIKE, Inc., Beaverton, OR (US)

(72) Inventor: Bryan N. Farris, North Plains, OR (US)

(73) Assignee: NIKE, Inc., Beaverton, OR (US)

( * ) Notice: Subject to any disclaimer, the term of this patent is extended or adjusted under 35 U.S.C. 154(b) by 558 days.

(21) Appl. No.: 15/050,851

(22) Filed: Feb. 23, 2016

(65) Prior Publication Data

US 2017/0238648 A1 Aug. 24, 2017

(51) Int. Cl.

| | |
|---|---|
| ***A43B 3/00*** | (2006.01) |
| ***A43B 3/26*** | (2006.01) |
| ***A43B 7/08*** | (2006.01) |
| ***A43D 8/18*** | (2006.01) |
| ***B26F 1/02*** | (2006.01) |
| ***A43B 13/12*** | (2006.01) |
| ***A43B 23/02*** | (2006.01) |

(52) U.S. Cl.

CPC ..... *A43B 3/26* (2013.01); *A43B 3/0078* (2013.01); *A43B 7/085* (2013.01); *A43B 13/12* (2013.01); *A43B 23/027* (2013.01); *A43D 8/18* (2013.01); *B26F 1/02* (2013.01)

(58) Field of Classification Search

CPC ..... B25D 5/00; B25D 5/02; B26F 1/32; B26F 1/34; B26F 1/36; B26F 1/365; A43B 3/26

USPC ..... 30/385–363

See application file for complete search history.

(56) References Cited

U.S. PATENT DOCUMENTS

| | | | | |
|---|---|---|---|---|
| 750,024 | A * | 1/1904 | Etnyre et al. | B26F 1/36 30/251 |
| 1,418,474 | A * | 6/1922 | Rosenberg | B26D 7/015 30/363 |
| 1,444,736 | A * | 2/1923 | Fowler | B26D 7/1818 30/363 |
| 1,510,451 | A * | 9/1924 | Spengler | B26F 1/36 30/363 |
| 2,374,089 | A | 4/1945 | Freeman et al. | |
| 4,033,037 | A * | 7/1977 | Cooley | B21D 28/24 30/363 |
| 4,398,358 | A | 8/1983 | Hilton | |
| 5,224,277 | A * | 7/1993 | Sang Do | A43B 7/081 36/27 |

(Continued)

FOREIGN PATENT DOCUMENTS

| | | |
|---|---|---|
| FR | 499075 A | 1/1920 |
| GB | 665308 A | 1/1952 |
| GB | 674588 A | 6/1952 |

OTHER PUBLICATIONS

International Search Report for Application No. PCT/US2017/018668, dated Jul. 18, 2017.

*Primary Examiner* — Jason Daniel Prone
*Assistant Examiner* — Richard D Crosby, Jr.
(74) *Attorney, Agent, or Firm* — Quinn IP Law

(57) ABSTRACT

A kit of parts may include an article of footwear and a customization device. The customization device and the article of footwear may be particularly designed to limit or prevent customization in particular areas of the article of footwear. Additionally, a method for customizing an article may include acquiring information regarding the fit of an article and forming apertures in the article using the fit information.

10 Claims, 20 Drawing Sheets

(56) References Cited

U.S. PATENT DOCUMENTS 5,315,767 A * 5/1994 Bradbury ..... A43B 3/16 36/135
5,343,638 A * 9/1994 Legassie ..... A43B 3/0005 36/28
5,377,415 A * 1/1995 Gibson ..... B26D 5/18 30/358
7,065,820 B2 6/2006 Meschter
7,513,064 B2 * 4/2009 Fuerst ..... A43B 1/14 36/102
8,303,885 B2 11/2012 Hatfield et al.
8,333,021 B2 12/2012 Johnson
D722,258 S * 2/2015 Murray ..... D8/52
D801,646 S * 11/2017 Townsend ..... D2/909
9,839,257 B2 * 12/2017 Fransko, Sr. ..... A43B 3/0078
2002/0124420 A1 * 9/2002 Hsuan ..... B26F 1/36 30/363
2002/0157278 A1 * 10/2002 Moretti ..... A43B 7/06 36/3 R
2004/0231189 A1 * 11/2004 Seamans ..... A43B 1/0081 36/3 A
2004/0231191 A1 * 11/2004 Seamans ..... A43B 1/0081 36/11.5
2005/0050740 A1 * 3/2005 Lin ..... B25B 7/04 30/363
2005/0076539 A1 * 4/2005 Klein ..... A43B 3/24 36/101
2006/0272165 A1 * 12/2006 Brenchley ..... B26F 1/32 30/358
2007/0130805 A1 * 6/2007 Brady ..... A43B 3/0078 36/136
2007/0151121 A1 7/2007 Touzov
2009/0313849 A1 * 12/2009 Shelton ..... A43B 3/0078 36/11.5
2011/0113654 A1 * 5/2011 Chew ..... A43B 1/0081 36/136
2011/0245748 A1 10/2011 Rinke
2012/0055042 A1 * 3/2012 Polegato Moretti ..... A43B 7/08 36/83
2012/0137530 A1 * 6/2012 Yun ..... A43B 3/00 33/370
2012/0192331 A1 * 8/2012 Fowler ..... A45C 13/001 2/12
2013/0036628 A1 * 2/2013 Hussey ..... A43B 3/0078 36/87
2013/0160326 A1 * 6/2013 Szekeresh ..... A43B 7/32 36/102
2013/0160328 A1 6/2013 Hatfield et al.
2013/0318827 A1 * 12/2013 Ringholz ..... A43B 3/24 36/100
2014/0020267 A1 * 1/2014 Perez ..... A43C 15/00 36/59 R
2014/0182170 A1 7/2014 Wawrousek et al.
2015/0257474 A1 * 9/2015 Campbell ..... A43B 3/242 36/101
2017/0238648 A1 * 8/2017 Farris ..... A43B 3/0078

* cited by examiner

ARTICLE OF FOOTWEAR INCLUDING PORTIONS CONFIGURED FOR CUSTOMIZATION

BACKGROUND

The present embodiments relate generally to articles of footwear, and in particular to articles of footwear with uppers and sole structures.

Articles of footwear generally include two primary elements: an upper and a sole structure. The upper may be formed from a variety of materials that are stitched or adhesively bonded together to form a void within the footwear for comfortably and securely receiving a foot. The sole structure is secured to a lower portion of the upper and is generally positioned between the foot and the ground. In many articles of footwear, including athletic footwear styles, the sole structure often incorporates an insole, a midsole, and an outsole. Some articles of footwear may cause discomfort to a user when worn. In such cases, the article may be customized to better fit the particular user.

SUMMARY

In one aspect, an embodiment includes a kit of parts. The kit of parts includes a completed article of footwear including an upper attached to a sole structure. The upper includes a first portion and a second portion. The first portion has a first interior surface and an opposite first exterior surface. The first portion has a first thickness between the first interior surface and the opposite first exterior surface. Additionally, the second portion has a second interior surface and an opposite second exterior surface. The second portion also has a second thickness between the second interior surface and the opposite second exterior surface. The kit further includes a customization device that is configured to form an aperture. The customization device has a guide surface and a lower surface. The guide surface is spaced from the lower surface by a clearance distance. Further, the clearance distance is larger than the first thickness thereby permitting the guide surface and the lower surface to enter the first portion. Additionally, the clearance distance is smaller than the second thickness thereby preventing the guide surface and the lower surface from entering the second portion.

In another aspect, an embodiment includes a kit of parts. The kit of parts includes a completed article of footwear including an upper attached to a sole structure. The upper includes a first portion and a second portion. The first portion has a first interior surface and an opposite first exterior surface. The first portion has a first thickness between the first interior surface and the opposite first exterior surface. Additionally, the second portion has a second interior surface and an opposite second exterior surface. The second portion also has a second thickness between the second interior surface and the opposite second exterior surface. The kit further includes a customization device that is configured to form an aperture. The customization device has a punch and a lower unit and the punch includes a punch surface and the lower unit includes a lower surface. The punch surface is spaced from the lower surface by a clearance distance. Further, the clearance distance is larger than the first thickness thereby permitting the punch surface and the lower surface to enter the first portion. Additionally, the clearance distance is smaller than the second thickness thereby preventing the punch surface and the lower surface from entering the second portion.

In another aspect, an embodiment includes a method of customizing an article of footwear. The method includes receiving a completed article of footwear including a completed upper attached to a sole structure. The method further includes a first portion of the upper and a second portion of the upper. The first portion has a first interior surface and a first exterior surface. Additionally, the second portion has a second interior surface and a second exterior surface. The method includes providing a customization device. The second interior surface and the second exterior surface prevent the customization device from entering the second portion. The method further includes positioning the customization device over the first portion. Further, the method includes forming an opening in the first portion using the customization device.

In another aspect, an embodiment includes a method of customizing an article of footwear. The method includes retrieving a completed article of footwear including a completed upper attached to a sole structure. The method further includes receiving information from a customer regarding fit of the completed article of footwear. The information from the customer includes regional fit information related to a particular region of the completed upper of the article of footwear. Further, the method includes using the regional fit information received from the customer to form at least one aperture in the particular region within the completed upper of the article of footwear thereby removing material from the completed upper.

Other systems, methods, features, and advantages of the embodiments will be, or will become, apparent to one of ordinary skill in the art upon examination of the following figures and detailed description. It is intended that all such additional systems, methods, features, and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
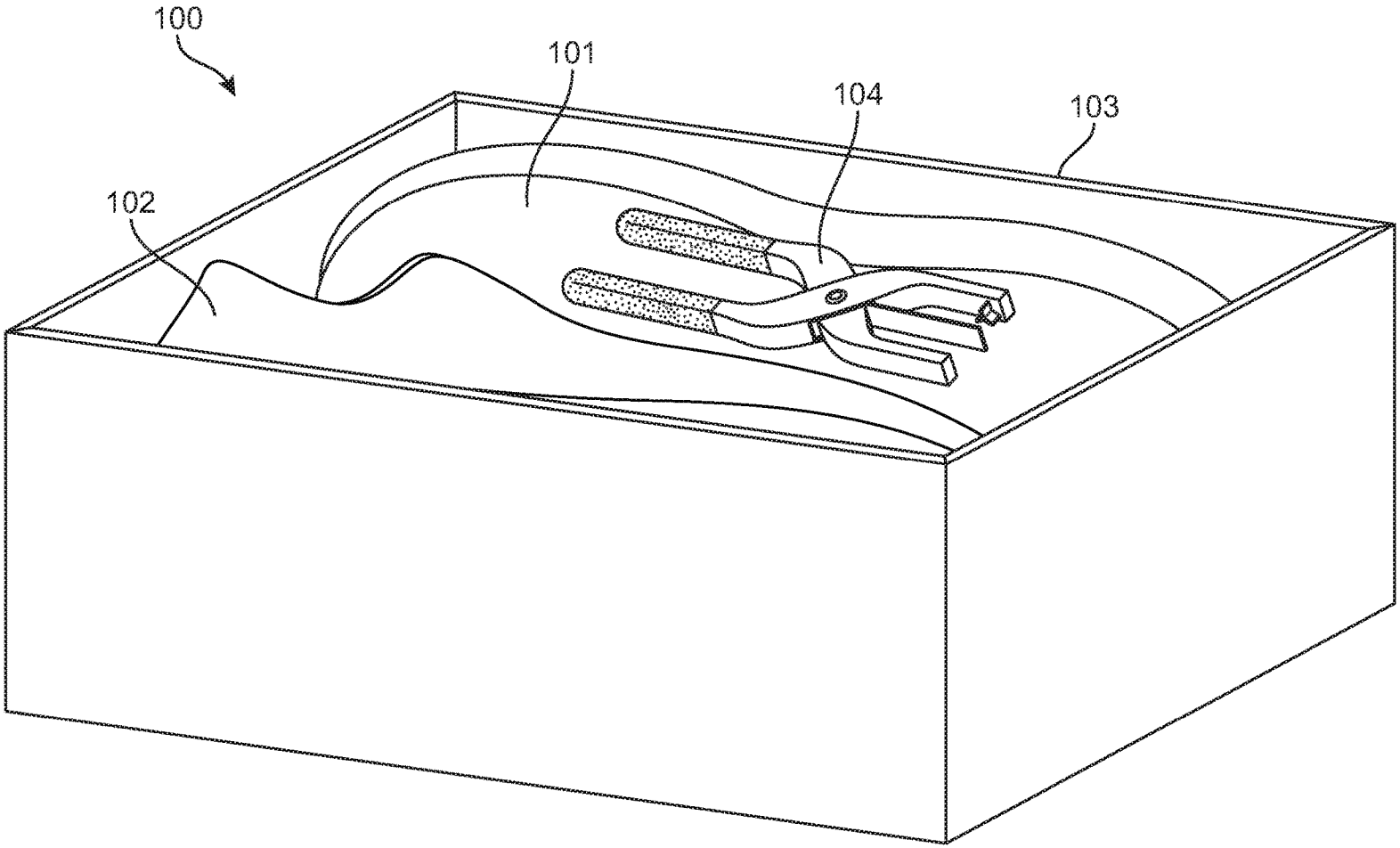
FIG. 1 is a schematic view of an embodiment of a kit of parts.
Figure 2:
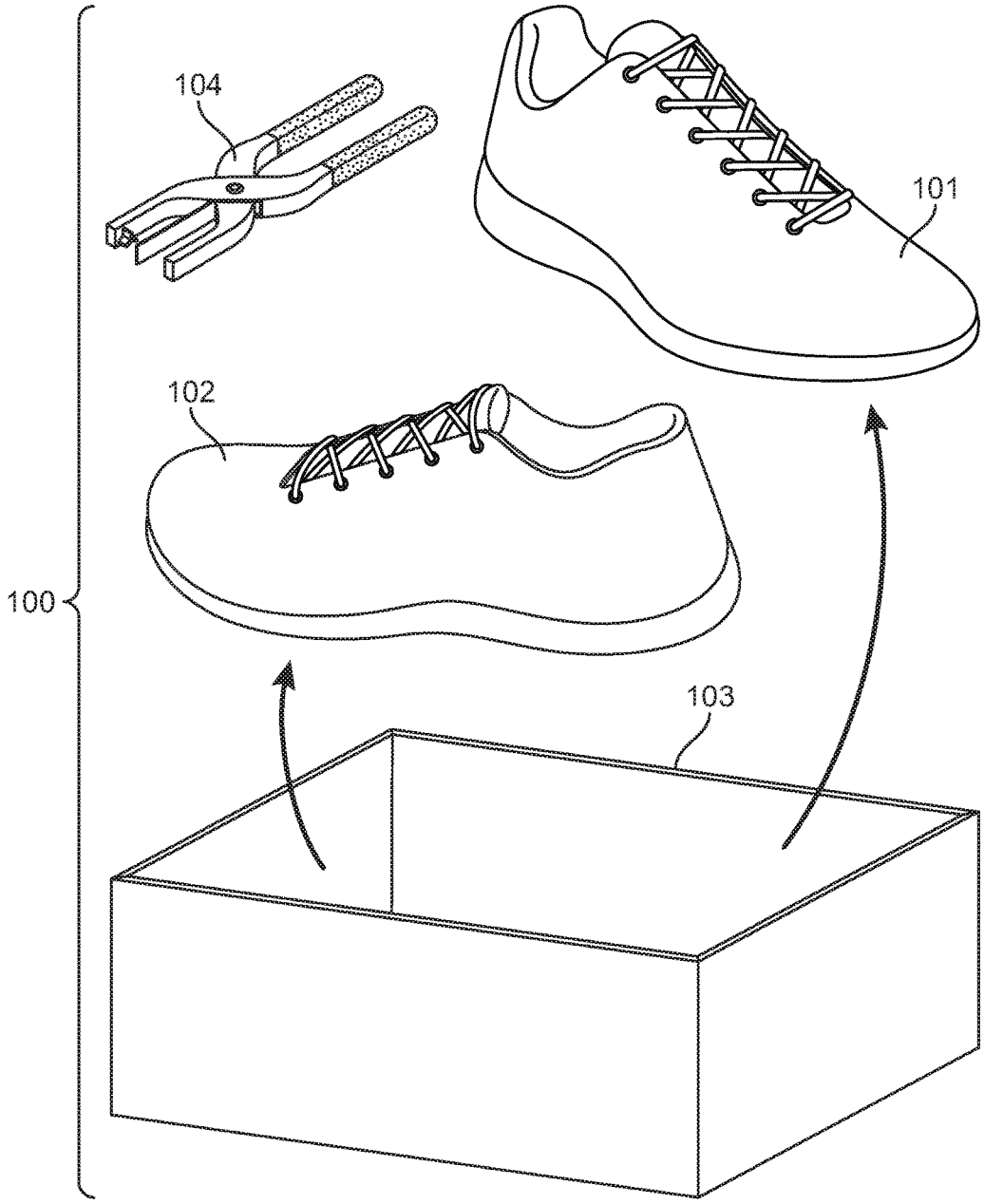
FIG. 2 is a schematic view of an embodiment of the individual items of the kit of parts.

FIGS. 1 and 2 depict a kit for customizing an article of footwear. As shown, kit 100 includes box 103 that stores first article of footwear 101 and second article of footwear 102. First article of footwear 101 may be referred to hereafter as simply first article 101. Additionally, second article of footwear 102 may be referred to hereafter as simply second article 102. As shown, first article 101 and second article 102 may be in the form of athletic shoes. However, in other embodiments, the provisions discussed herein for first article 101 and second article 102 may be incorporated into various other kinds of footwear including, but not limited to, basketball shoes, hiking boots, soccer shoes, football shoes, sneakers, running shoes, cross-training shoes, rugby shoes, baseball shoes as well as other kinds of shoes. Moreover, in some embodiments, the provisions discussed herein for first article 101 and second article 102 could be incorporated into various other kinds of non-sports-related footwear, including, but not limited to, slippers, sandals, high-heeled footwear, and loafers. Additionally, first article 101 may be referred to throughout this application for ease of discussion. It should be recognized that the discussion of features and elements may also be applied to second article 102.

The embodiments may be characterized by various directional adjectives and reference portions. These directions and reference portions may facilitate in describing the portions of an article of footwear. Moreover, these directions and reference portions may also be used in describing subcomponents of an article of footwear (e.g., directions and/or portions of an inner sole component, a midsole component, an outer sole component, an upper, or any other components). The term "longitudinal" as used throughout this detailed description and in the claims refers to a direction oriented along a length of a component (e.g., an upper or sole component). In some cases, a longitudinal direction may be parallel to a longitudinal axis that extends between a forefoot portion and a heel portion of the component. Also, the term "lateral" as used throughout this detailed description and in the claims refers to a direction oriented along a width of a component. In some cases, a lateral direction may be parallel to a lateral axis that extends between a medial side and a lateral side of a component. Furthermore, the term "vertical" as used throughout this detailed description and in the claims refers to a direction generally perpendicular to a lateral and longitudinal direction. For example, in cases where an article is planted flat on a ground surface, a vertical direction may extend from the ground surface upward. Additionally, the term "inner" refers to a portion of an article disposed closer to an interior of an article, or closer to a foot when the article is worn. Likewise, the term "outer" refers to a portion of an article disposed further from the interior of the article or from the foot. Thus, for example, the inner surface of a component is disposed closer to an interior of the article than the outer surface of the component. This detailed description makes use of these directional adjectives in describing an article and various components of the article, including an upper, a midsole structure, and/or an outer sole structure.

When people purchase various articles to wear, the article may not perfectly fit the person. Because of the variability of fit among wearers, it is unlikely that an article will perfectly fit every person without particular information from the wearer. In some cases, an article may be too tight or too loose. In other cases, an article may not stretch in the correct areas. Wearers may, therefore, desire to alter the articles so that the articles fit better upon the wearer. In some cases, the wearer may alter the article by himself or herself. In other cases, the wearer may relay information regarding fit and feel in a particular region to a third party, such as a service representative. The service representative may then alter the article in accordance with the regional fit information received from the wearer. In some cases, a person may seek to alter an article of footwear.

In some embodiments, a kit may include provisions for customizing an article of footwear. As shown in FIGS. 1 and 2, kit 100 includes a customization device. In some embodiments, the customization device may be configured to alter an article of footwear in a particular manner. As shown, customization device 104 is configured to form apertures, holes, or openings in an article of footwear such as first article 101.

In some embodiments, the customization device may be a unitary piece. In the embodiment as depicted in FIGS. 1 and 2, customization device 104 is a unitary piece. That is, customization device 104 includes an upper unit and a lower unit that are movably attached to one another. Other various types of customization devices may also be included in kit 100.

Figure 3:
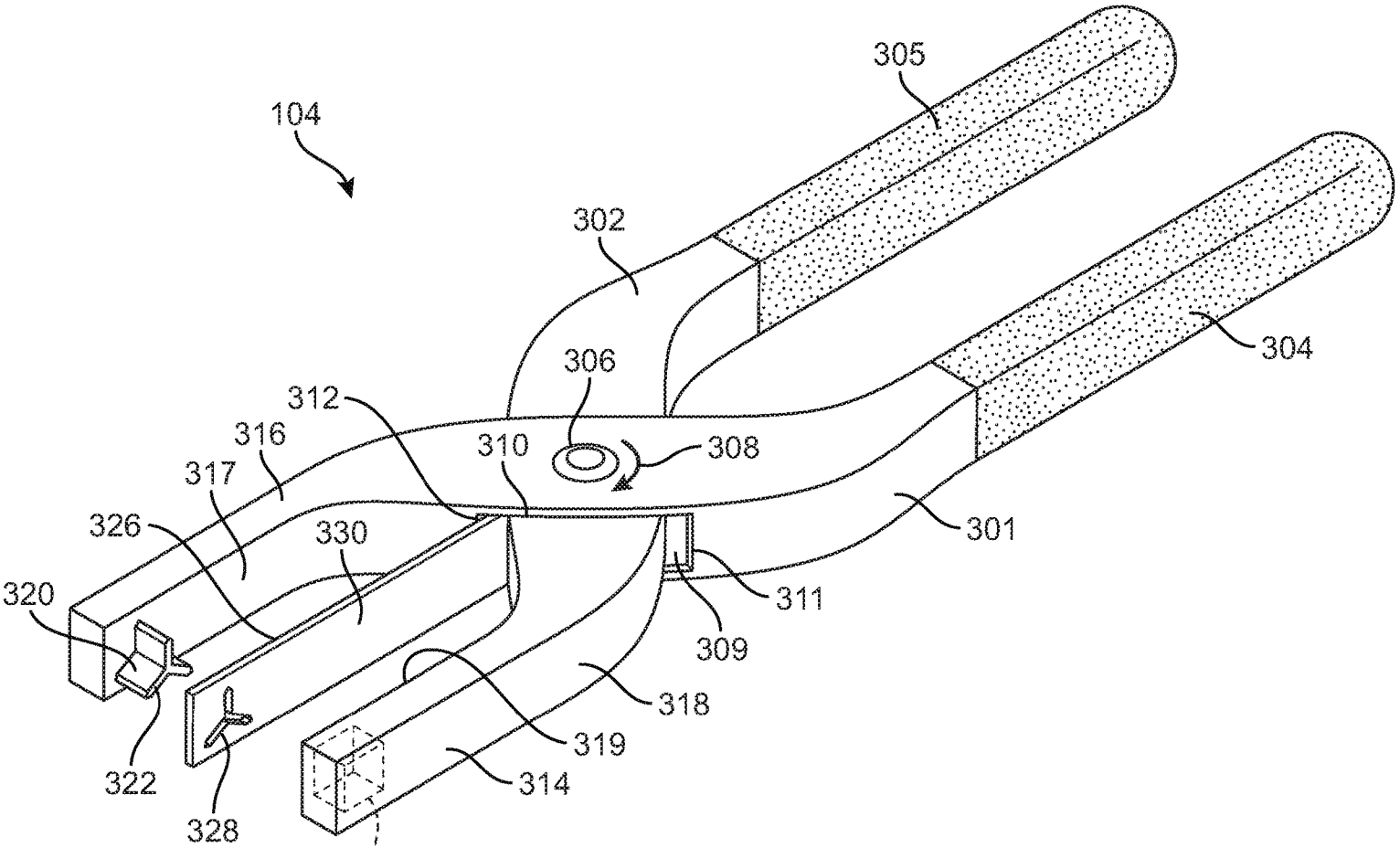
FIG. 3 is a schematic view of an embodiment of a customization device.

Referring now to FIG. 3, customization device 104 is depicted in isolation from other component of kit 100. In some embodiments, customization device 104 may include first portion 301 and second portion 302. First portion 301 may include lower handle 304 while second portion 302 may include upper handle 305. Additionally, first portion 301 may be connected to second portion 302 by pin 306. In some embodiments, pin 306 may refer to a screw, nail, rivet, or other fastening device. In some embodiments, pin 306 may be removable. In other embodiments, pin 306 may be a permanent fixture that movably attaches first portion 301 to second portion 302. As used in this detailed description, movably attached describes the relationship between two or more pieces. Pieces that are movably attached to one another are able to translate, or rotate with respect to one another; however, each piece is physically attached to the other piece. For example, pin 306 physically attaches first portion 301 to second portion 302. First portion 301 and second portion 302 may rotate along direction 308. If pin 306 were removed, first portion 301 could move without impedance from second portion 302.

In some embodiments, the customization device may include provisions for limiting the motion of portions of the customization device with respect to each other. In some embodiments, the geometry of portions of the customization device may limit the motion of portions of the customization device with respect to each other. As shown, first portion 301 includes opening 309. Opening 309 is large enough so that second portion 302 may extend through opening 309. Opening 309 includes perimeter 310 that defines the size and shape of opening 309. Further, perimeter 310 includes rearward portion 311 and forward portion 312. In some embodiments, opening 309 may provide a restriction on the distance that first portion 301 and second portion 302 may rotate with respect to one another. In the embodiment as shown, as upper handle 305 is rotated away from lower handle 304, lower surface 314 of second portion 302 may contact rearward portion 311 of perimeter 310. Rearward portion 311 may, therefore, prevent upper handle 305 from continuing to rotate away from lower handle 304.

In some embodiments, the customization device may include portions that may move relative to one another. In some embodiments, the customization device may include portions that may interact or intersect with one another to form a pinching or pressing motion to form apertures in a material. In some embodiments, first portion 301 may include upper jaw 316 that is located on an opposite end of first portion 301 from lower handle 304. Additionally, second portion 302 may include lower jaw 318 that is located on an opposite end of second portion 302 from upper handle 305. As upper handle 305 is rotated closer to lower handle 304, lower jaw 318 also rotates toward upper jaw 316, thereby forming a pinching motion between lower jaw 318 and upper jaw 316.

In some embodiments, the customization device may include a shape-defining portion. In some embodiments, the shape-defining portion may be a punch, for example punch 320 of customization device 104. Punch 320 may be used to form an opening, aperture, or hole in a material. Punch 320 may be pressed into a material to cut the material such that a hole is formed in the material that corresponds in shape and size to punch 320. For example, punch surface 322 is in a tri-star shape. Therefore, when punch 320 is pressed against a material and cuts a material, the shape of the aperture formed by punch 320 may correspond to the shape and size of punch surface 322.

In some embodiments, the shape-defining portion may be located in various areas of customization device 104. In some embodiments, punch 320 may be located on upper jaw 316. In other embodiments, punch 320 may be located on lower jaw 318. As shown in FIG. 3, punch 320 is located on upper jaw 320. Additionally, punch 320 is located on interior surface 317 of upper jaw 316. That is, punch 320 is located on the surface of upper jaw 316 that faces interior surface 319 of lower jaw 318.

In some embodiments, the customization device may include provisions for receiving a punch. In some embodiments, lower jaw 318 may include a recessed portion. In some embodiments, the recessed portion may be in the shape of a cavity that has the same or similar shape to the shape of punch 320. As shown, cavity 324 is located in lower jaw 318. Cavity 324 may correspond in shape and size to punch 320. That is, the cross section of cavity 324 may be similar to the shape and size to the cross section of punch 320 and of punch surface 322. Additionally, the depth of cavity 324 may be similar to the distance from punch surface 322 to interior surface 319 of upper jaw 316. In other embodiments, cavity 324 may have a different shape and size from punch 320. For example, cavity 324 may have a square-shaped cross section that also allows punch 320 to extend into cavity 324. Additionally, in other embodiments, customization device 104 may not include a cavity. During use, punch 320 may cut a material and continue through the material into cavity 324. Punch surface 322, along with the edge of cavity 324, may provide a cutting surface that may form a more complete opening or aperture than in embodiments that do not include a cavity.

In some embodiments, customization device 104 may include provisions to limit the thickness of material that customization device 104 may alter. In some embodiments, the provisions may include a physical portion of customization device 104 that physically limits customization device 104 from entering portions of a material. As shown in FIG. 3, guide plate 326 extends from a portion of lower jaw 318. As shown, guide plate 326 is spaced from interior surface 319 of lower jaw 318. The space between guide surface or lower surface 330 of guide plate 326 and a lower surface or interior surface 319 of lower jaw 318 may correspond to the thickness of the material that customization device may be configured to alter. As discussed in further detail in this detailed description, guide plate 326 may interfere with a material thereby preventing customization device 104 from entering a particular area of the material.

In some embodiments, a guide plate may include an aperture, hole, or opening that corresponds in shape and size to the shape of the punch. As shown in FIG. 3, guide plate 326 includes aperture 328. The cross section of aperture 328 may correspond in shape and size to punch surface 322. Aperture 328 may guide punch 320 so that punch 320 remains in alignment with cavity 324 or with interior surface 319 of lower jaw 318 during use. In other embodiments, aperture 328 may provide an opening through which punch 320 may pass. In some embodiments, for example, aperture 328 may not correspond in shape to punch 320. Rather, aperture 328 may be sized such that punch 320 may extend through aperture 328 when upper jaw 316 is pressed toward lower jaw 318.

Figure 5:
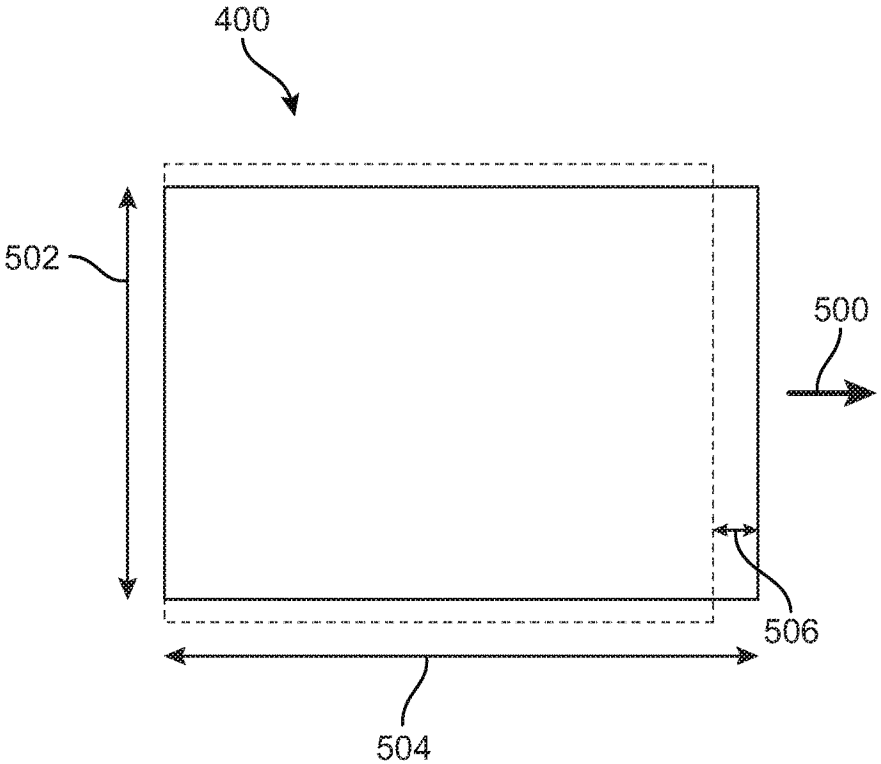
FIG. 5 is a schematic view of an embodiment of the portion of material subjected to a tensile force.
Figure 4:
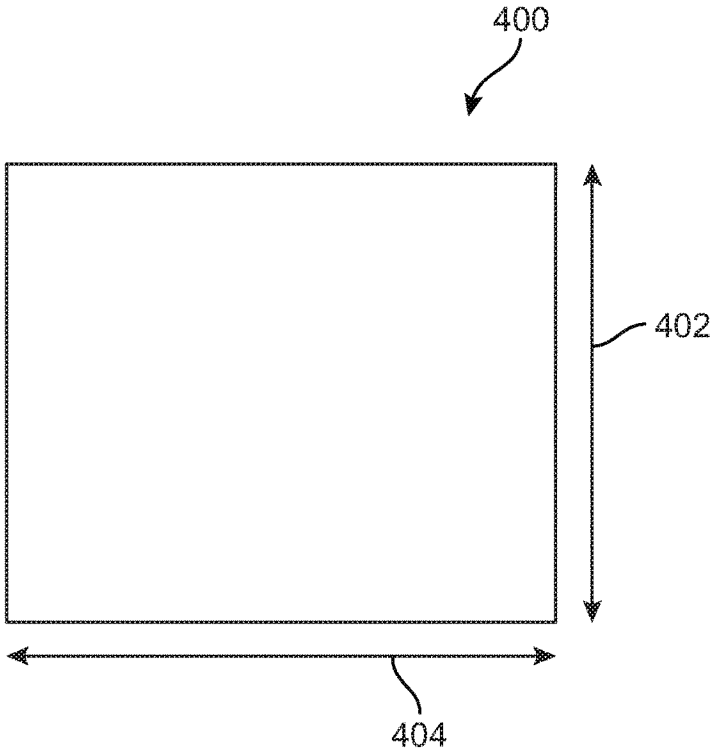
FIG. 4 is a schematic view of an embodiment of a portion of a material in an untensioned configuration.

Referring now to FIGS. 4 and 5, a portion of a material is shown. As shown in FIG. 4, swatch 400 is in an undisturbed or untensioned state. In this configuration, there are no forces that are acting upon swatch 400 in order to stretch or deform swatch 400. As shown, swatch 400 has first height 402 and first length 404. Swatch 400 may be any type of material including woven, non-woven, and knit material.

Referring to FIG. 5, swatch 400 may be subjected to tensile force 500 along the length of swatch 400. As shown, when tensioned, swatch 400 has second height 502 and second length 504. Second length 504 may be larger than first length 404. Additionally, second height 502 is less than first height 402. Because swatch 400 is a non-auxetic material and does not include auxetic structures, swatch 400 has a positive Poisson's ration. That is, when subjected to a tensile force in a first direction, swatch 400 extends in the first direction, and retracts or diminishes in a direction perpendicular to the first direction. As shown in FIG. 5, swatch 400 extends along the length of swatch 400 and diminishes along the height of swatch 400.

In the present configuration, swatch 400 may not stretch or extend to a large degree. For example, swatch 400 extends distance 506. As discussed in this detailed description, when incorporated into an article of footwear, the relatively small distance that swatch 400 extends may cause discomfort to a user. For example, a user may desire more stretch than the material may provide in the configuration shown in FIGS. 4 and 5 of swatch 400.

Figure 7:
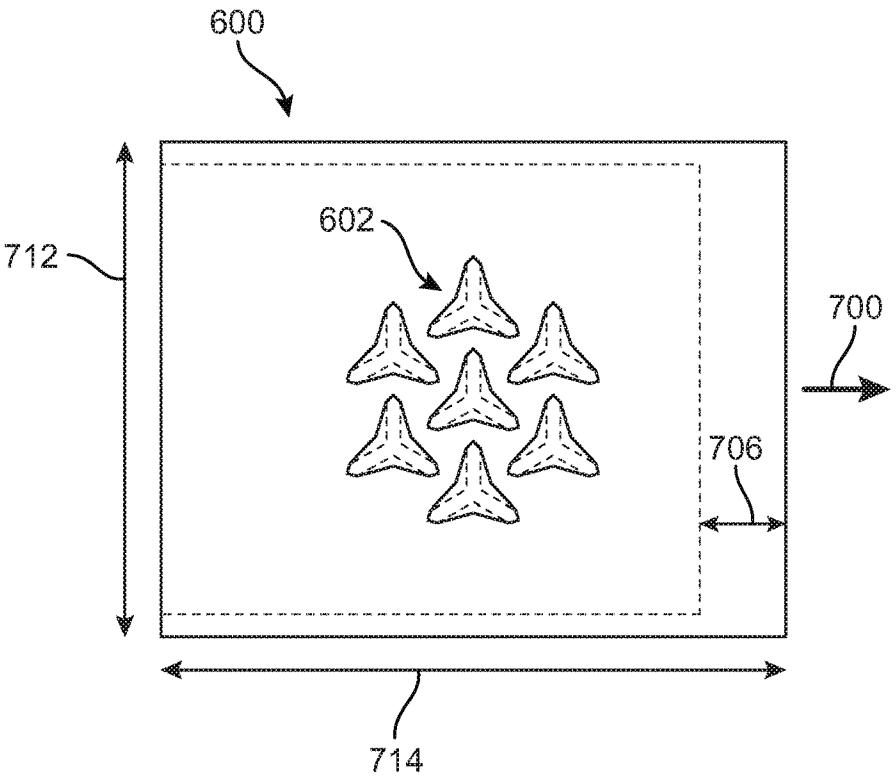
FIG. 7 is a schematic view of an embodiment of a portion of material that includes a plurality of apertures subjected to a tensile force.
Figure 6:
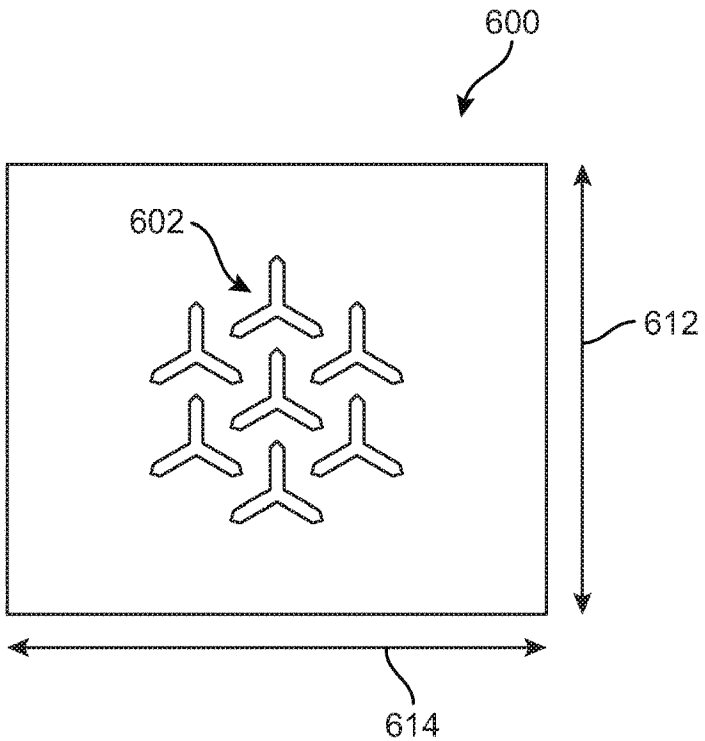
FIG. 6 is a schematic view of an embodiment of a portion of material that includes a plurality of apertures in an untensioned configuration.

Referring now to FIGS. 6 and 7, an alternate embodiment of a swatch is shown. Swatch 600 may be formed from the same material that forms swatch 400; however, swatch 600 includes a plurality of apertures. In some embodiments, plurality of apertures 602 may be located in various areas of swatch 600. In some embodiments, plurality of apertures 602 may be formed throughout the entire area of swatch 600. In other embodiments, plurality of apertures 602 may be located in certain regions of swatch 600. For example, in some embodiments, the apertures may extend to an end or edge of swatch 600. In other embodiments, plurality of apertures 602 may be surrounded such that the apertures do not extend to an edge of swatch 600. By varying the location of plurality of apertures 602, the stretch of swatch 600 is varied in different regions. Additionally, swatch 600 includes first height 612 and first length 614.

In some embodiments, plurality of apertures 602 may include apertures that are different shapes from adjacent apertures. That is, in some embodiments, plurality of apertures 602 may include an aperture of a first shape and a first size and a second aperture of a second shape and second size. The first shape and first size being different than the second size and the second shape. In other embodiments, each aperture of plurality of apertures 602 may have the same or similar shape. By changing the shape and size of the apertures of plurality of apertures 602, the stretch of swatch 600 may be augmented or tuned for a particular stretch capability.

In some embodiments, plurality of apertures 602 may have various shapes. In some embodiments, the apertures of plurality of apertures 602 may have an auxetic shape. That is, in some embodiments, plurality of apertures 602 may contribute to an auxetic structure or effect on a material. An auxetic structure, when tensioned in a first direction, will extend in a second direction that is perpendicular to the first direct. Such auxetic structures are characterized by having a negative Poisson's ratio. For example, if the structure can be described as having a length, a width, and a thickness, then when the structure is under tension along the length, the structure also increases in width. In certain embodiments, the auxetic structures are bi-directionally reactive such that they increase in length and width when stretched longitudinally and in width and length when stretched laterally, but do not increase in thickness. Also, although such auxetic structures will generally have at least a monotonic relationship between the applied tension and the increase in the dimension orthogonal to the direction of the tension. That relationship need not be proportional or linear, and in general need only increase in response to increased tension. As shown, plurality of apertures 602 have an auxetic shape. The effect of tensioning an article including apertures similar in shape to the apertures of plurality of apertures 602 is described in Cross et al., U.S. Patent Publication Number 2015/0075033, published Mar. 19, 2015, and filed Sep. 18, 2013, the entirety of which is hereby incorporated by reference.

Referring now to FIG. 7, tensile force 700 is exerted along the length of swatch 600. As shown, the shape of plurality of apertures 602 is augmented such that the apertures are shaped similarly to triangles. This change in shape causes the dimension of swatch 600 to change. As shown, swatch 600 extends along the length of swatch 600 as well as along the height of swatch 600. For example, second height 712 is larger than first height 612. Additionally, second length 714 is larger than first length 614. When compared to swatch 400, swatch 600 may be configured to stretch or extend along both length and height a greater amount. For example, second height 712 of swatch 600 may be larger than second height 502 of swatch 400. In other words, distance 706 of tensioned swatch 600 may be larger than distance 506 of tensioned swatch 400. In some embodiments, second height 712 of swatch 600 may also be larger than first height 402 of swatch 400 before swatch 400 is subjected to tensile force 500. This difference is due to, in some embodiments, swatch 600 being configured with apertures arranged in an auxetic configuration. Additionally, in some embodiments, second length 714 of swatch 600 may be larger than second length 504 of swatch 400. Because swatch 600 includes plurality of apertures 602, swatch 600 may be able to stretch or extend to a greater extent than swatch 400 when subjected to a tensile force along the length of swatch 600. Plurality of apertures 602 removes material from swatch 600, thereby eliminating resistance from the material that restricts the ability of swatch 400 to extend to the same amount. That is, even in embodiments in which the shape of plurality of apertures 602 is not auxetic, swatch 600 may still be able to stretch or extend along the length of swatch 600 a greater amount when tensioned as compared to when swatch 400 is tensioned along the length of swatch 400.

In some embodiments, swatch 600 may include a varying number of apertures. By changing the number of apertures in swatch 600, the flexibility, stretch, and auxetic effect may be altered. For example, a swatch with a greater number of apertures may stretch to a greater degree when subjected to a tensile force when compared to a swatch with less of the same-sized apertures. Additionally, by changing the size of the apertures, the amount of stretch may also be altered. For example, a swatch with larger apertures than another swatch with the same number of smaller apertures may stretch to a greater degree when subjected to a tensile force. This is because the swatch with larger apertures has less material that resists the stretching of the material.

Figure 8:
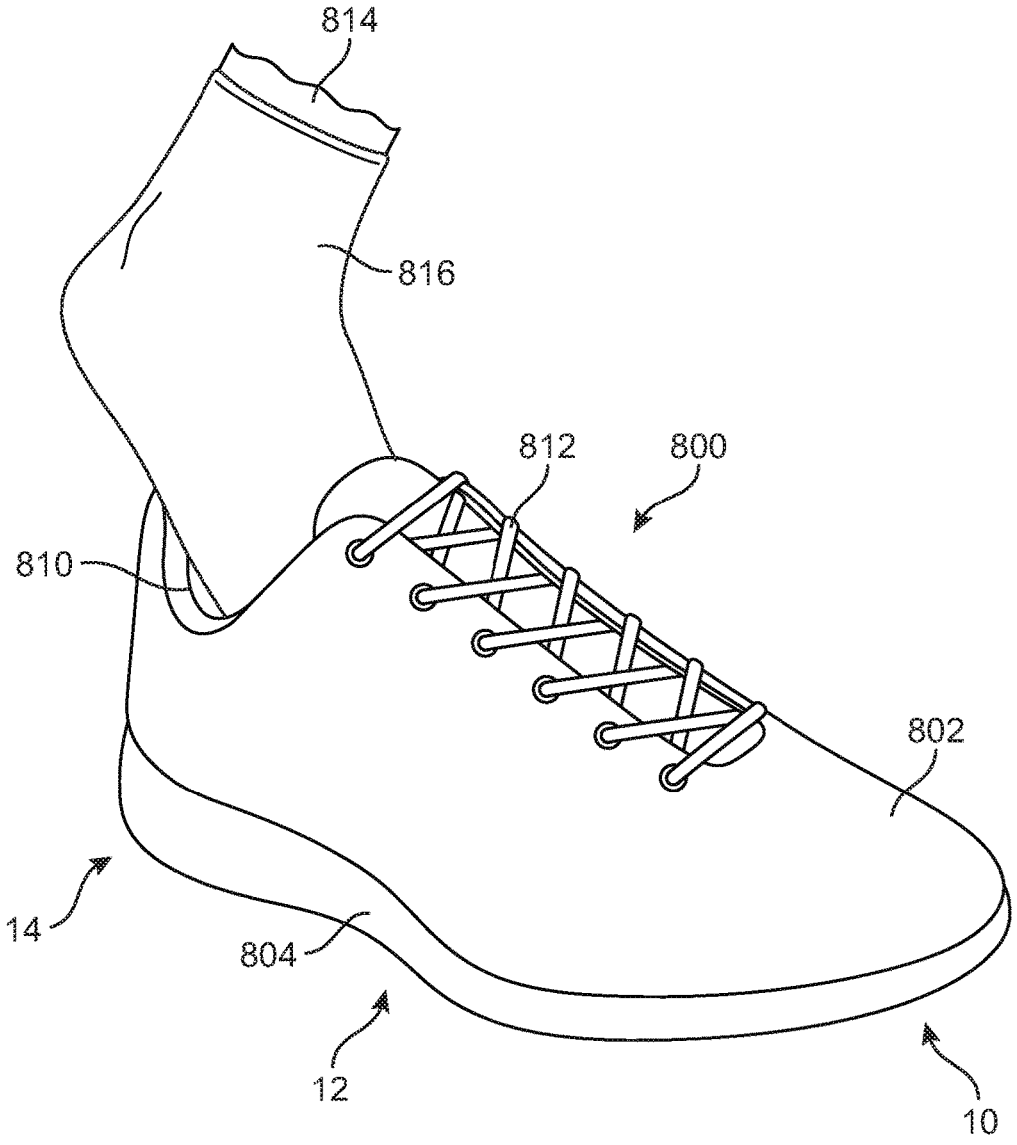
FIG. 8 is a schematic view of an embodiment of a foot of a user being inserted into an article of footwear.
Figure 9:
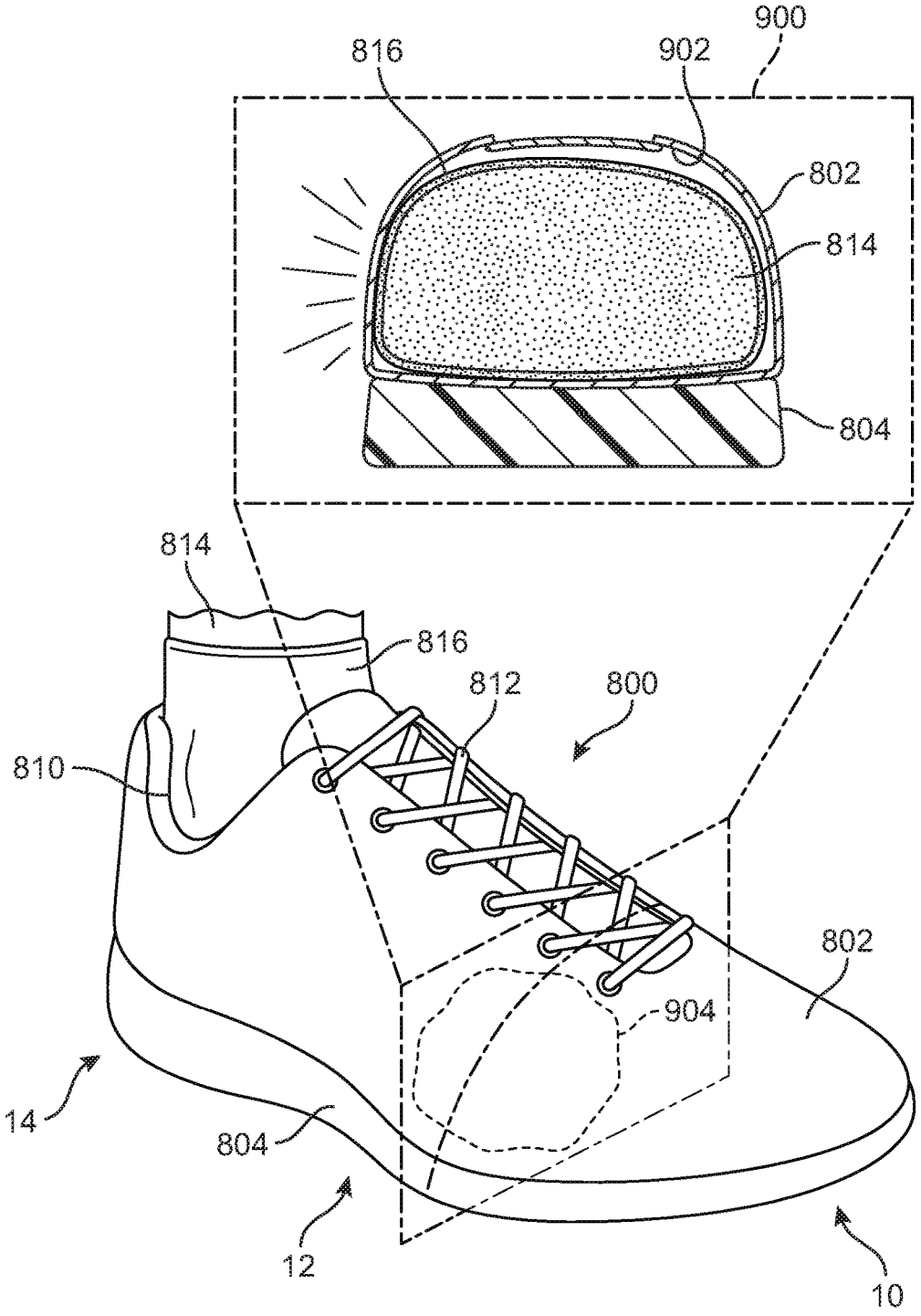
FIG. 9 is a schematic view of the fit of an article of footwear.

Varying the shape, size, number, and location of apertures in a material may be applied to articles of footwear to adjust the stretch in various regions on the article of footwear. Referring to FIGS. 8 and 9, the fit of an article of footwear is shown with regard to a user. Article of footwear 800, referred to hereafter as simply article 800 may include upper 802 and sole structure 804. Upper 802 may include opening or throat 810 that allows the wearer to insert his or her foot into article 800. In some embodiments, upper 802 may also include laces 812, which can be used to tighten or otherwise adjust upper 802 around a foot. For purposes of illustration, only some provisions of upper 802 are shown; however, it will be understood that upper 802 may include additional provisions in various embodiments.

Article 800 has forefoot region 10, instep or midfoot region 12, and heel region 14. These regions may also be applied to components of article 800 and their relative position in relation to article 800. The regions are not intended to demarcate precise areas of footwear. Rather, forefoot region 10, midfoot region 12, and heel region 14 are intended to represent general areas of article 100 to aid in the following discussion.

In different embodiments, sole structure 804 could comprise one or more components. For example, sole structure 804 could include an insole, midsole, and/or an outsole. In some embodiments, sole structure 804 may comprise a midsole layer and a distinct outsole. However, in other embodiments, sole structure 804 could comprise a single component that functions as a midsole and outsole for sole structure 804. That is, in at least some embodiments, sole structure 804 may provide cushioning and traction, as well as possibly other provisions, for article 800. Although not illustrated in the exemplary embodiment, some other embodiments may have a distinct outsole component that could incorporate a tread pattern, or may have cleats, spikes, or other ground-engaging protuberances.

In different embodiments, upper 802 may be formed of material with different structures. In some embodiments, upper 802 may be formed of a non-woven material. In other embodiments, upper 802 may be formed of a material with a woven structure or a knit structure. In still further embodiments, upper 802 may be formed of a combination of materials with various structures. Additionally, upper 802 may be formed of various materials. For example, in some embodiments, upper 802 may include areas formed of natural material or synthetic material. Upper 802 may also include fusible material as well as thermoplastic material.

As shown in FIGS. 8 and 9, user's foot 814 is inserted into article 800 through opening or throat 810. In some embodiments, foot 814 may be inserted into sock 816 prior to inserting foot 814 into article 800. In some embodiments, when user's foot 814 is inserted into article 800, there may be areas of article 800 that cause discomfort to the user. For example, in some embodiments, upper 802 of article 800 may press against areas of user's foot 814, causing increased pressure, rubbing, or otherwise some form of discomfort to the user. In some embodiments, provisions for providing increased stretchability or flexibility in particular areas may decrease the level of discomfort to the user.

Referring particularly to FIG. 9, user's foot 814 has been placed within article 800. As shown in cross-section 900, user's foot 814 rubs against or presses against interior surface 902 of upper 802 along contact area 904. In some embodiments, the pressing of interior surface 902 against user's foot 814 may cause discomfort to the user. Additionally, in some embodiments, the area of discomfort may be particularized. That is, although one area of article 800 causes discomfort to a user, other areas of article 800 may fit comfortably around user's foot 814. For example, in this embodiment, contact area 904 may cause discomfort to the user at least partially in forefoot region 10; however, other areas of article 800 may not cause discomfort to the user. Further, in other embodiments, various other areas of article 800 may cause discomfort to the user by rubbing against user's foot 814 or by not stretching to accommodate user's foot 814. The areas may be located in heel region 14, midfoot region 12, in addition to forefoot region 10.

Figure 10:
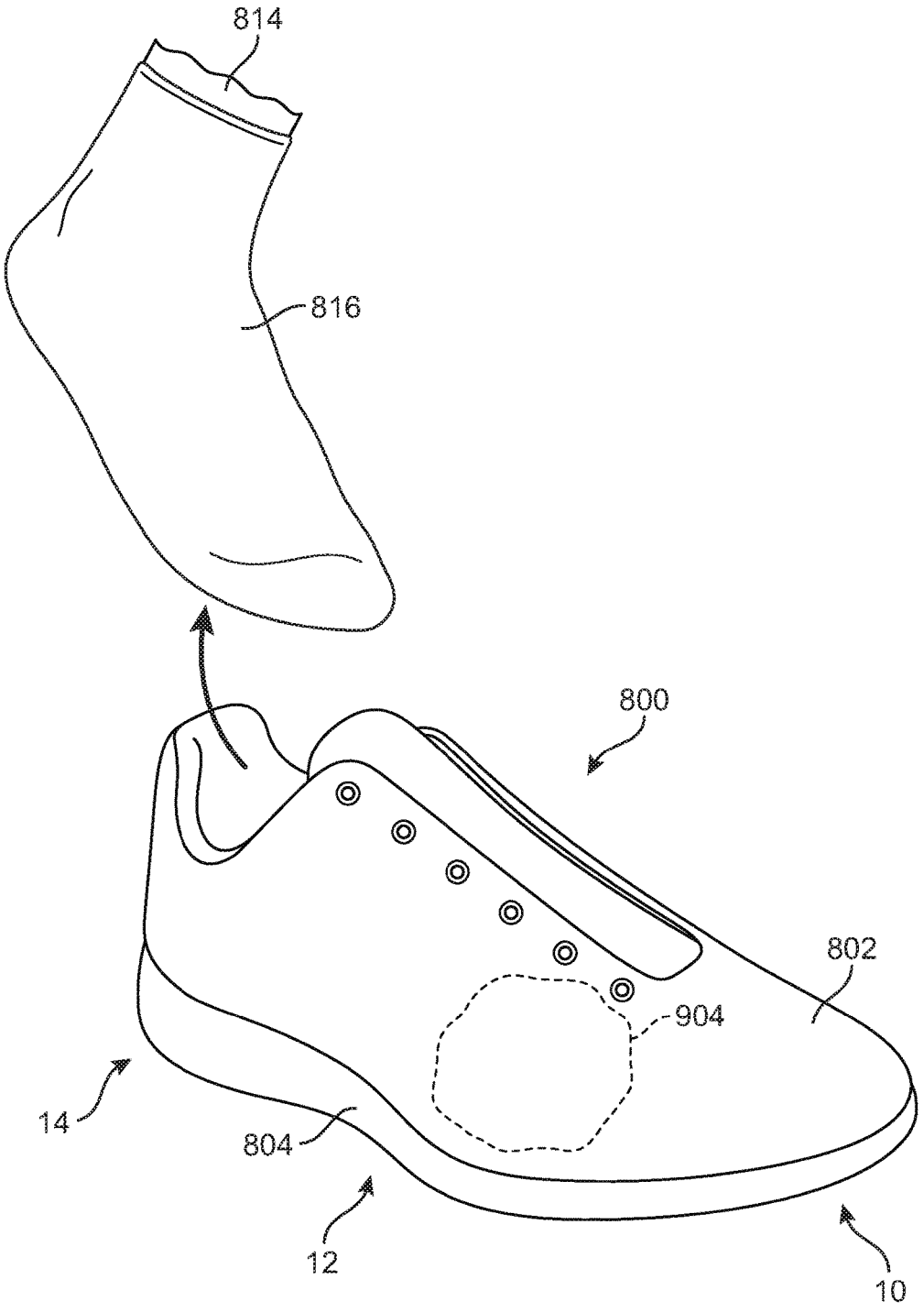
FIG. 10 is a schematic view of an embodiment of a foot of a user being removed from an article of footwear.

In some embodiments, the information pertaining to the contact area or area of discomfort may be acquired for use in customizing the article. Once the particular area, in this case contact area 904, is identified, user's foot 814 may be removed from article 800 as shown in FIG. 10. By determining the area in which the discomfort arises, the area may be customized in order to provide a better fit to the user. In some embodiments, prior to removing user's foot 814, contact area 904 may be marked using a pen, pencil, or other marking device. In addition, in some embodiments, contact area 904 may be physically altered; for example, an indentation may be pressed or etched into contact area 904 to identify the area to be customized. Further, in some embodiments, information relating to the area of discomfort and the type of discomfort may be communicated to a third party, for example, a service representative or a computer.

In some embodiments, the upper may include markings or indicia indicating areas where apertures may be formed. In other embodiments, other areas of upper 802 may include indicia instructing users not to form apertures in these areas. In other embodiments, as discussed later in this detailed description, the upper may be dimensioned to prevent areas of the upper from being customized.

Figure 11:
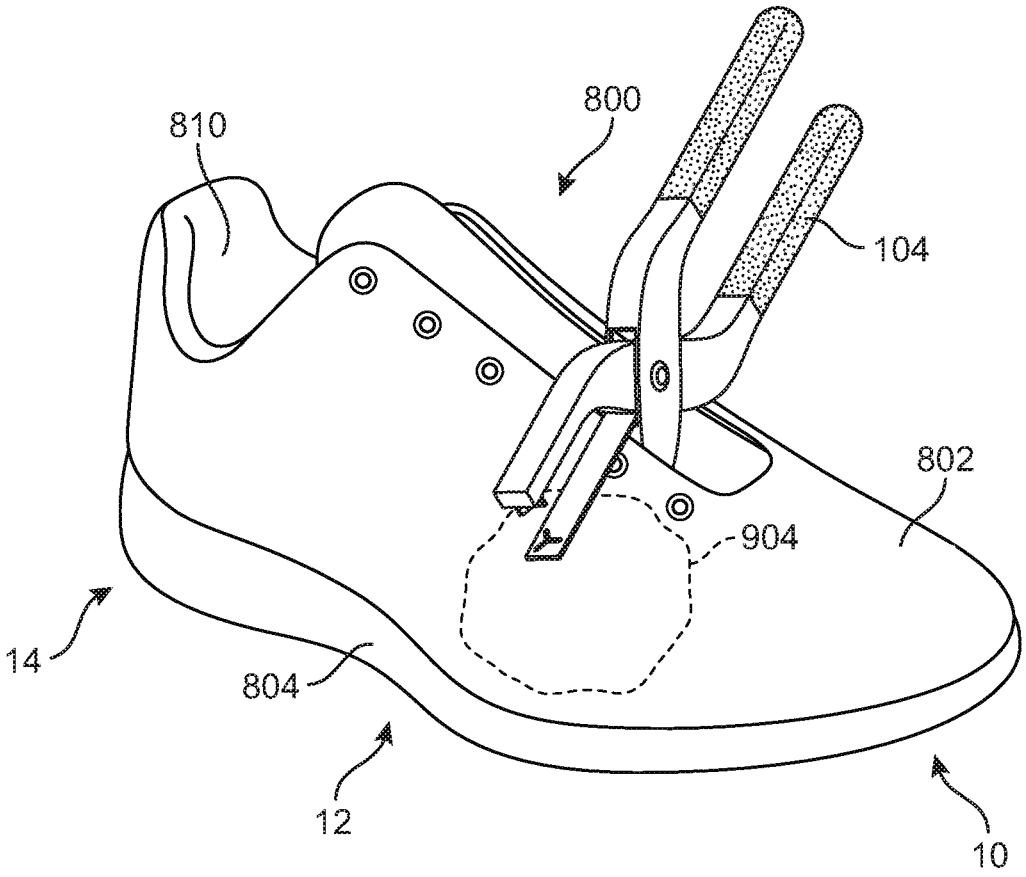
FIGS. 11-13 are schematic views of an embodiment of an article being customized by a customization device to include apertures.

Referring now to FIG. 11, customization device 104 may be positioned around upper 802 to form apertures in contact area 904. Although contact area 904 is shown in forefoot region 10, it should be recognized that in other embodiments a contact area may be located in heel region 14 or midfoot region 12. In some embodiments, as shown, laces 812 may be removed from article 800 to allow for customization device 104 to easily extend along both the interior surface and exterior surface of upper 802. Using the information received from the user and gathered by the user, apertures may be placed within contact area 904 to permit upper 802 to stretch to a greater degree in the area that includes apertures as compared to areas of the same material that do not include apertures.

In some embodiments, a customer service representative may receive information from a customer, and the representative may use various tools to form apertures in upper 802. In some embodiments, for example, the representative may use a laser to form the apertures. In other embodiments, the representative may use a customization device, such as customization device 104 shown in FIG. 11. Further, in some embodiments, heat may be applied while forming apertures. For example, in embodiments in which the upper includes fusible material, heat may be applied to fuse the material together. Additionally, in other embodiments, heat may be used to strengthen the aperture opening such as to prevent fraying along the aperture. In other embodiments, the customer may form the openings using customization device 104.

Figure 25:
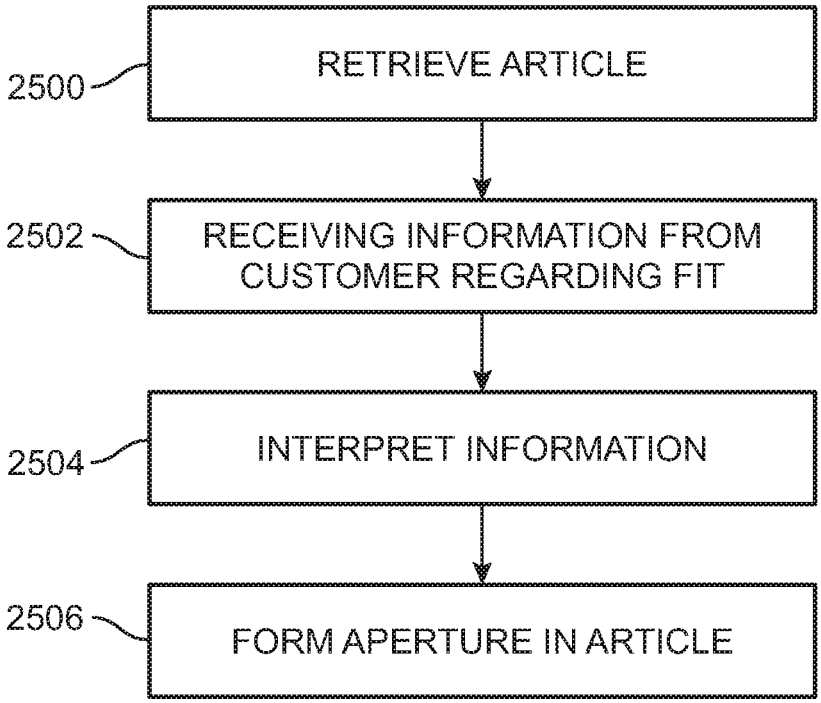
FIG. 25 is a flow chart depicting a method of customizing an article.

Referring now to FIG. 25, a flow chart depicting an embodiment of the steps used to customize an article of footwear is depicted. In step 2500, an article of footwear is retrieved. In some embodiments, the article may be retrieved from a customer, while in other embodiments, the article may be retrieved from a store or other location by a customer service representative for example. Once the article is retrieved, the customer may wear the article to determine the fit and feel of the article. The service representative may then receive information regarding fit in step 2502. The information received may include regional fit information. Further, the information may include regional information regarding various regions in the article. For example, in some embodiments, the information received may include information regarding fit in the heel region as well as fit information regarding fit in the forefoot region. Once the information is received, the information may be interpreted in step 2504. In this step, the area of customization may be determined. Additionally, in some embodiments, the size, spacing, and number of apertures to be formed in the article may be determined. After step 2504, at least one aperture may be formed in the article as depicted in step 2506. In some embodiments, multiple apertures may be formed in the article. The number, spacing, location, and size of the apertures formed within the article may correspond to the interpreted information of step 2504.

The number of apertures may be varied. For example, in some embodiments, the user may experience only slight discomfort or pinching from upper 802. In such embodiments, a single aperture may be sufficient to provide adequate stretch to reduce the discomfort of a user. In other embodiments, a user may desire to have greater stretch in contact area 904. In such embodiments, a greater number of apertures may be utilized to allow for a greater degree of stretch. The information received and acquired may assist in determining not only where the apertures should be formed but also how many or what size the apertures should be.

Figure 12:
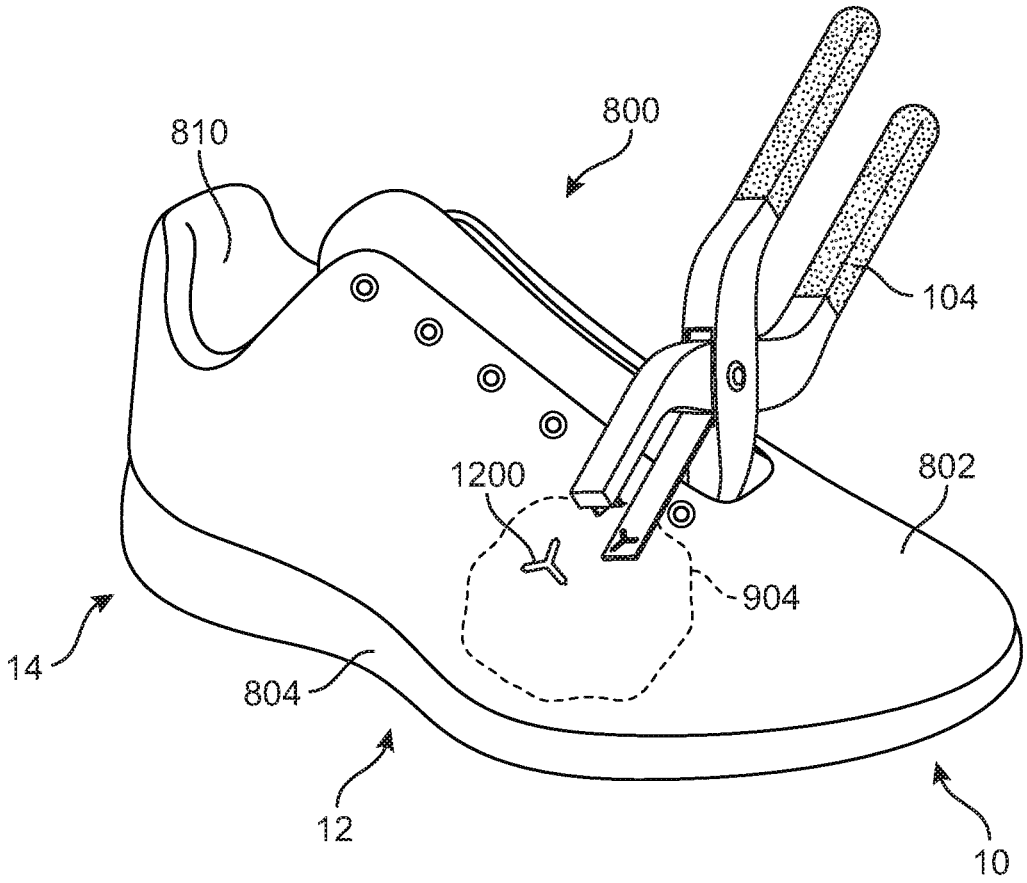

As shown in FIG. 12, first aperture 1200 is formed in contact area 904. As shown, first aperture 1200 has an auxetic shape. That is, the shape of first aperture 1200 may assist in providing an auxetic effect to upper 802 when upper 802 is stretched in contact area 904. The auxetic effect, as discussed previously, is the effect that when stretched in a first direction, the material that has auxetic structures or properties will expand along the first direction and a second direction that is perpendicular to the first direction. This effect is described in Cross et al., U.S. Patent Publication Number 2015/0075033, published Mar. 19, 2015, and filed Sep. 18, 2013, the entirety of which is hereby incorporated by reference.

In some embodiments, apertures formed in upper 802 may have various shapes. In some embodiments, the apertures may have an auxetic shape. In other embodiments, the apertures may not have an auxetic shape. For example, in some embodiments, the apertures may be circular, rectangular, triangular or other shapes. As discussed previously, the removal of material from a portion of an upper may allow the upper to stretch to a greater degree when compared to portions of the upper that do not include apertures. Therefore, even in embodiments in which the shape of the apertures is not auxetic, the material including the apertures will stretch to a greater degree when compared to the same material that does not include apertures.

Figure 13:
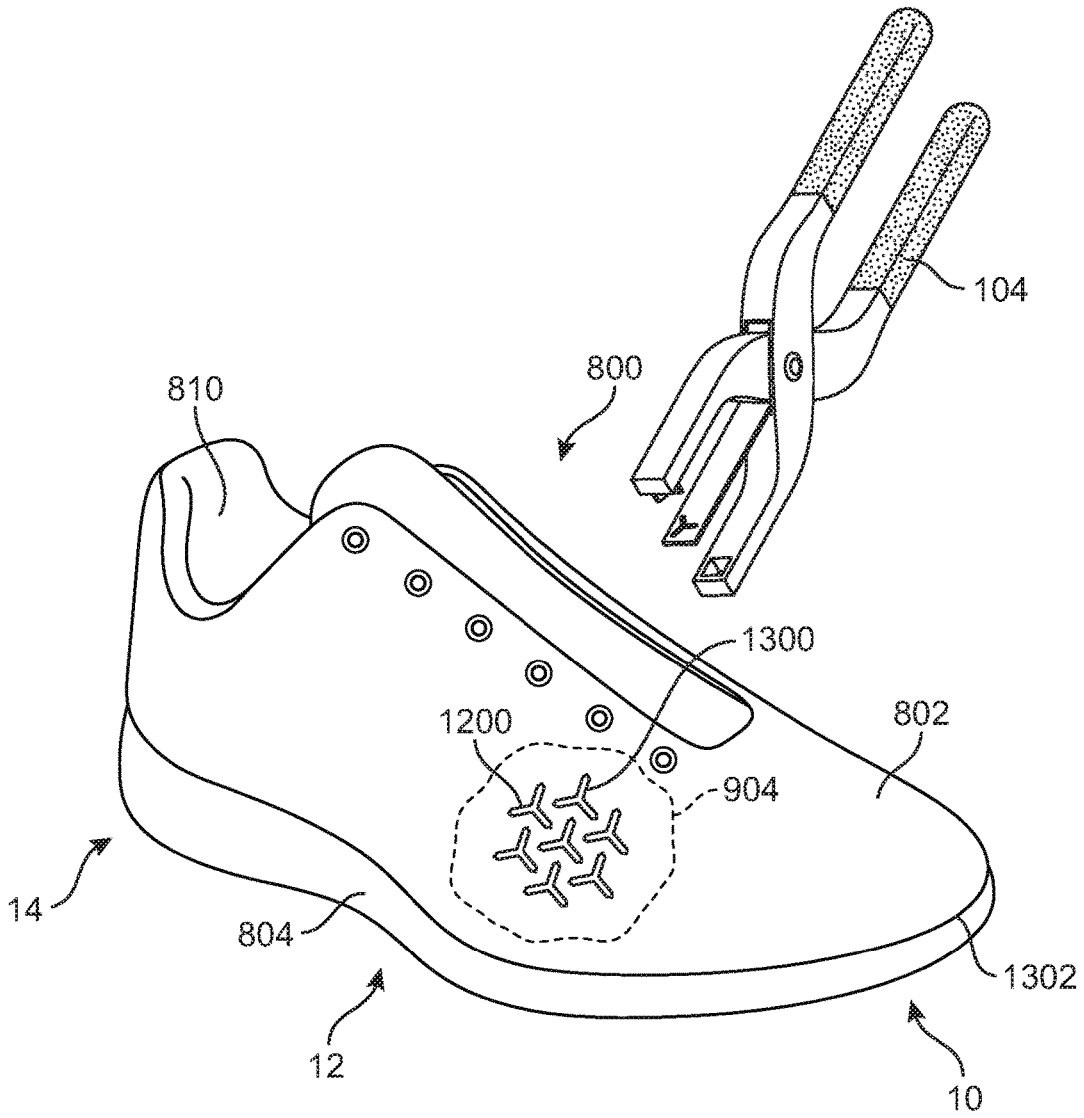

In some embodiments, apertures may be particularly placed with respect to one another. In some embodiments, apertures may be arranged such that a larger number of apertures may be positioned within a given area. For example, referring to FIG. 13, second aperture 1300 may be positioned toward toe edge 1302 of article 800 and located vertically above first aperture 1200. By locating second aperture 1300 diagonally adjacent to first aperture 1200, more apertures may be arranged within a given area. Further, by incorporating a larger number of apertures in a certain area, the degree to which the area stretches may be increased. Additionally, in embodiments that include apertures of auxetic shapes, the larger the number of auxetic shapes in a given area, the greater the auxetic effect of that area may be.

Figure 14:
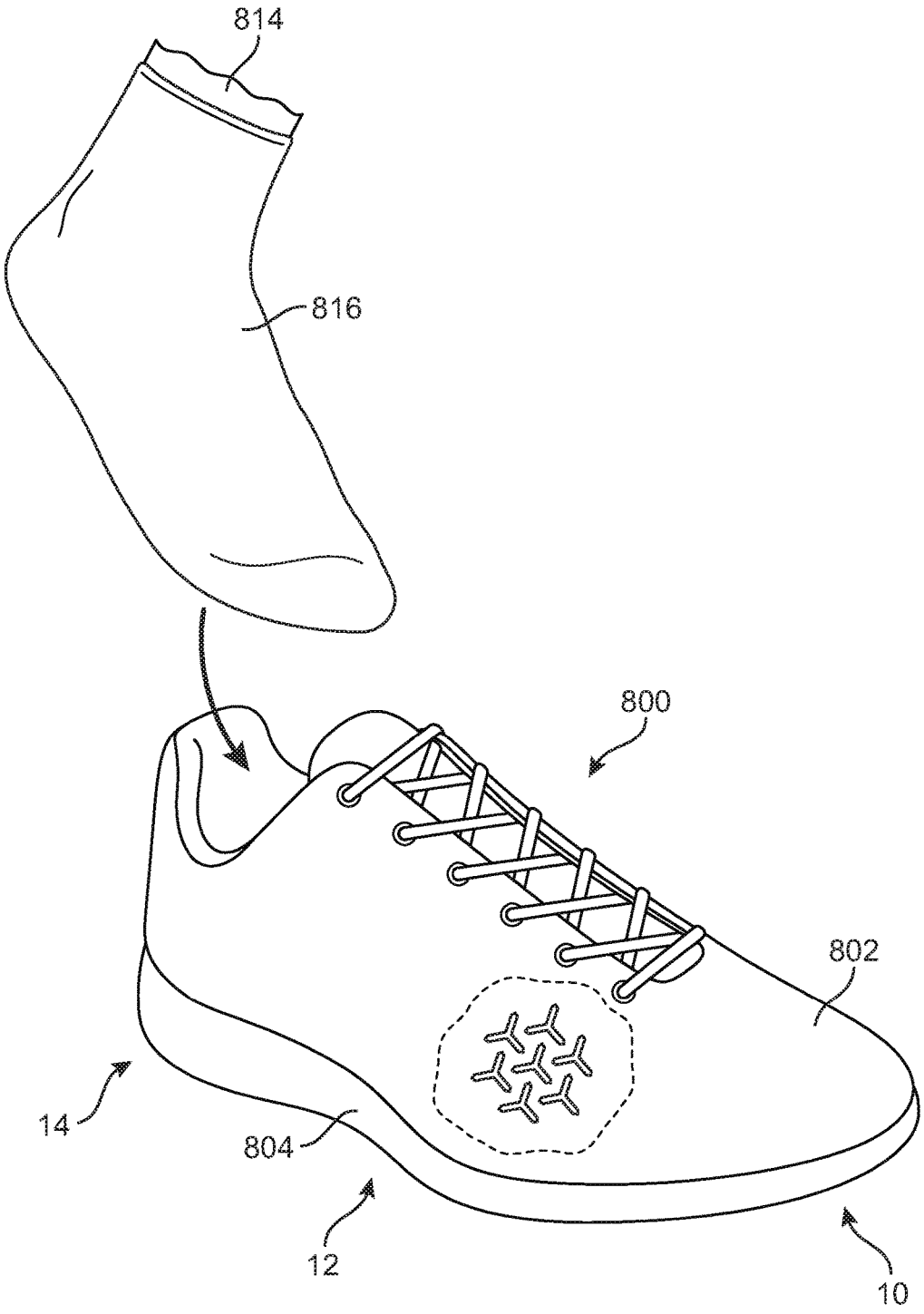
FIGS. 14-16 are schematic views of an embodiment of a foot being inserted into the article of footwear.
Figure 15:
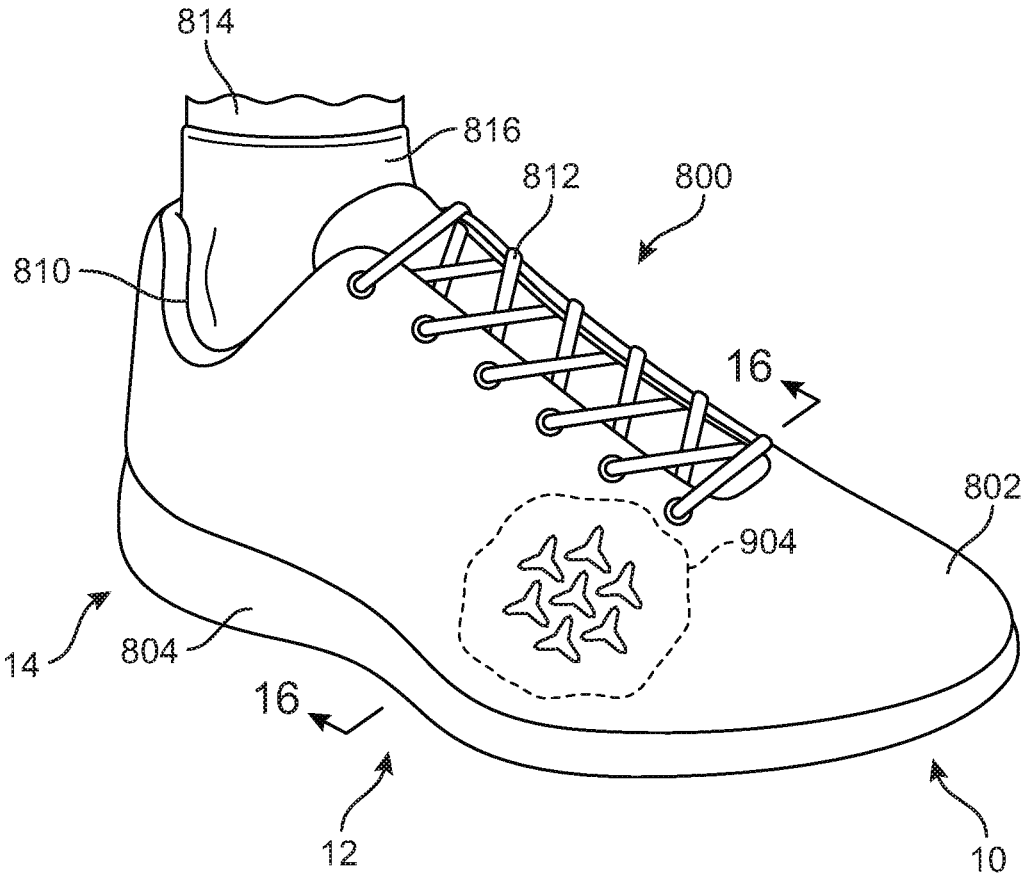
Figure 16:
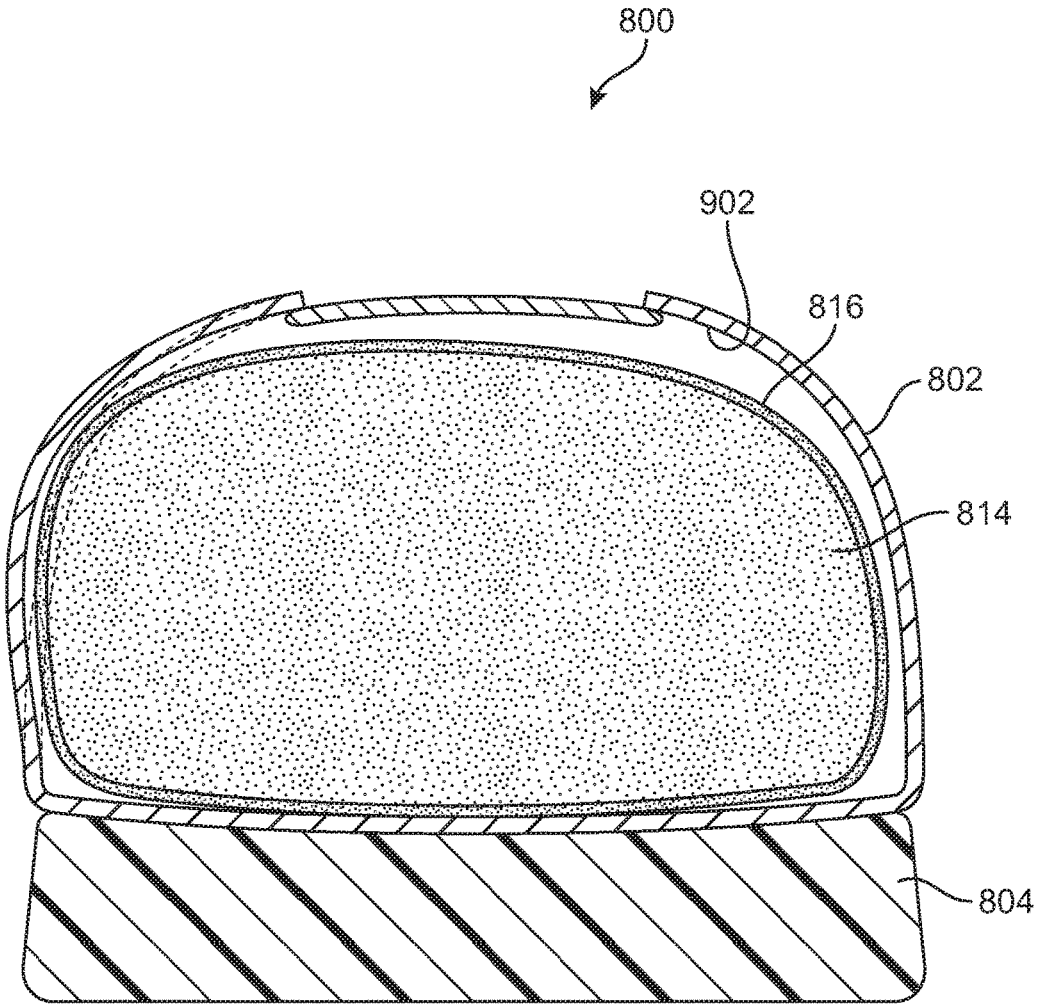

Referring now to FIGS. 14-16, user's foot 814 may be inserted into article 800 after the desired number of apertures are formed in contact area 904 of upper 802 of article 800. Because contact area 904 now includes a plurality of apertures, upper 802 may stretch and conform to user's foot 814 better than when compared to contact area 904 without a plurality of apertures. Upper 802 may stretch to accommodate the size and shape of user's foot 814. As shown in FIG. 16, upper 802 may bulge along contact area 904 to accommodate the shape of user's foot 814. As shown, interior surface 902 may be in a different location when compared to interior surface 902 of article 800 prior to the apertures being formed in upper 802.

In some embodiments, an article of footwear may include provisions for limiting customization in particular areas. For example, in some embodiments, a first portion of the article may be configured for customization. That is, apertures may be formed in the first portion. In contrast, a second portion of the article may not be configured for customization. In some embodiments, the article may include provisions to prevent the second portion of the article from being customized. In some embodiments, the second portion may be formed of a material that is not easily customized, or the second portion may be an integral part of the article and, therefore, customizing the second portion may alter the structural integrity of the article. Additionally, other reasons may exist for preventing the second portion of the article from being customized.

Figure 17:
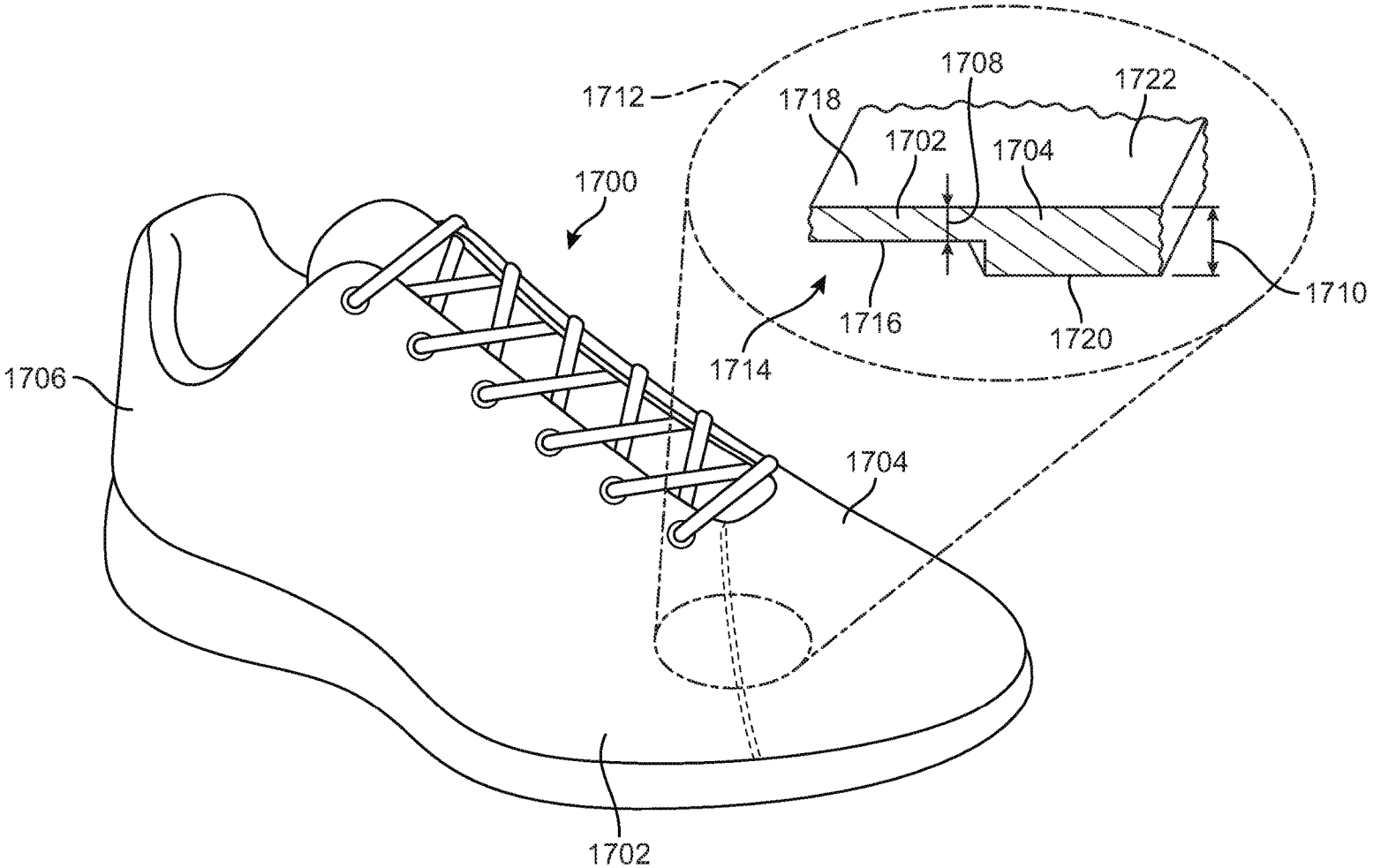
FIG. 17 is a schematic view of an embodiment of an article of footwear including an upper with portions of different thicknesses.

Referring to FIG. 17, article 1700 includes first portion 1702 and second portion 1704. As shown, second portion 1704 may correspond to a toe cap of article 1700, and first portion 1702 may refer to a portion of upper 1706 other than the toe cap. Additionally, cross-section 1712 includes cutaway portion 1714 of first portion 1702 and second portion 1704.

In some embodiments, second portion 1704 may refer to a portion of article 1700 that does not support customization or in which customization is not desired. In some embodiments, second portion 1704 may be integral to the shape or integrity of article 1700 and therefore second portion 1704 may be precluded from customization. In order to reduce the possibility of accidental customization of second portion 1704, the thickness of second portion 1704 may be different than the thickness of first portion 1702. In some embodiments, the thickness of second portion 1704 may be greater than the thickness of first portion 1702. For example, distance 1710 of second portion 1704 may be greater than distance 1708 of first portion 1702. As shown in cross-section 1712, the thickness of first portion 1702 relates to the distance from the interior surface of first portion 1702 to the exterior surface of first portion 1702. For example, distance 1708 is the distance from interior surface 1716 of first portion 1702 to exterior surface 1718 of first portion 1702. Furthermore, distance 1710 is the distance from interior surface 1720 of second portion 1704 to exterior surface 1722 of second portion 1704. As discussed with relation to the upper of an article, the interior surface relates to the surface disposed adjacent to a foot of a user when the article is in use. Additionally, exterior surface relates to the surface opposite of the interior surface.

As shown in FIG. 17, exterior surface 1718 of first portion 1702 and exterior surface 1722 of second portion 1704 may align or form a substantially planar surface. In other embodiments, exterior surface 1718 of first portion 1702 and exterior surface of second portion 1704 may not align. Additionally, in some embodiments, interior surface 1716 of first portion 1702 and interior surface 1720 of second portion 1704 may be substantially planar with one another. As shown in FIG. 17, however, interior surface 1716 of first portion 1702 and interior surface 1720 of second portion 1704 do not form a planar surface. The alignment or non-alignment of the surfaces of first portion 1702 and second portion 1704 may be altered for aesthetic reasons as well as reasons related to comfort or fit as well as other reasons.

Figure 18:
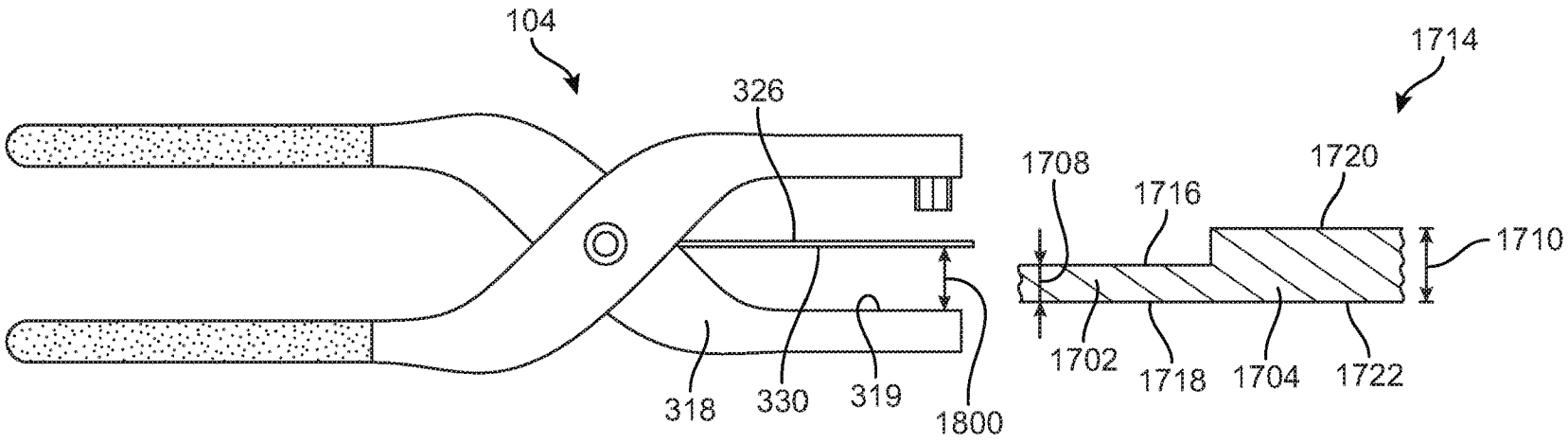
FIGS. 18-20 are schematic views of an embodiment of a customization device being used on various portions of an article of footwear.
Figure 19:
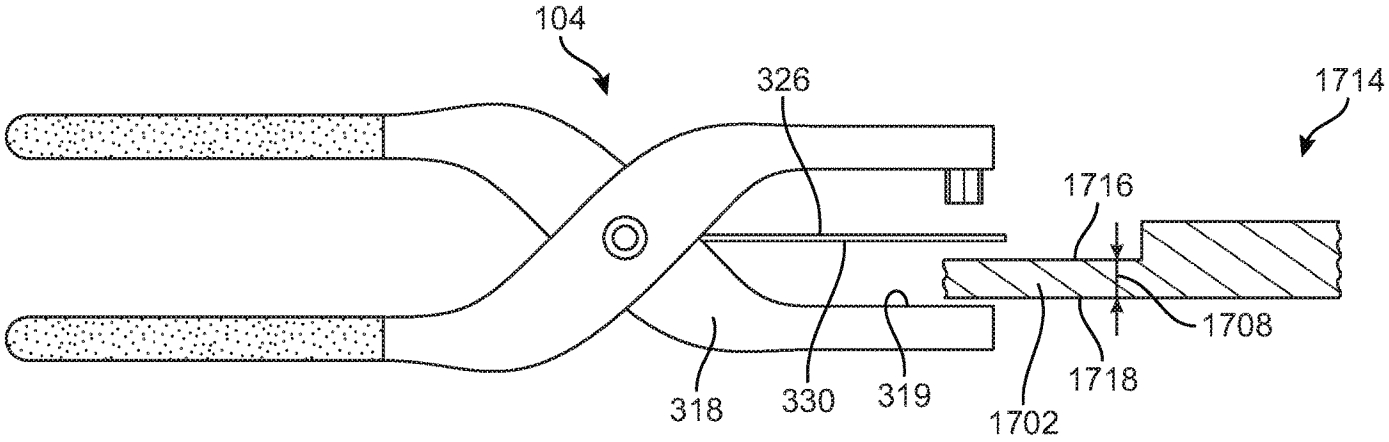
Figure 20:
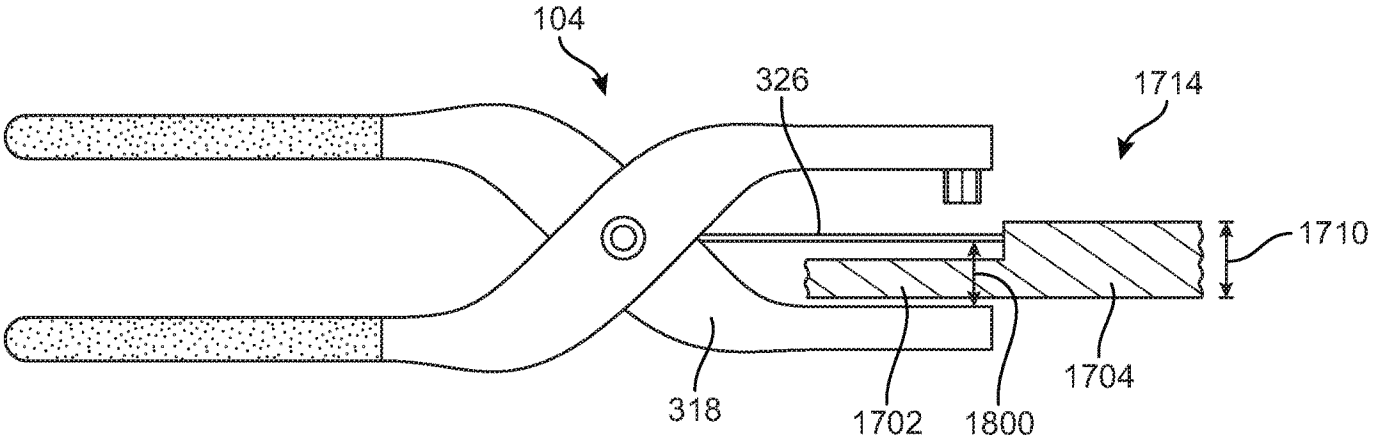

In some embodiments, the thickness of portions of the upper of an article of footwear may correspond to particular dimensions of a customization device. In some embodiments, the thickness of the portions may permit the customization device to enter certain portions while restricting the customization device from entering other portions. The orientation of cutaway portion 1714 has been flipped in the following figures for ease of description. Referring to FIGS. 18-20, cutaway portion 1714 is shown along with customization device 104. As shown, interior surface 319 of lower jaw 318 of customization device 104 is spaced clearance distance 1800 away from lower surface 330 of guide plate 326. Clearance distance 1800 may be larger than distance 1708 that corresponds to the thickness of first portion 1702. By spacing interior surface 319 of lower jaw 318 away from lower surface 330 of guide plate 326, customization device 104 may be able to enter first portion 1702. That is, interior surface 319 of lower jaw 318 may be able to be located adjacent to exterior surface 1718 of first portion 1702 while lower surface 330 of guide plate 326 is located adjacent to interior surface 1716 of first portion 1702. In other words, interior surface 319 of lower jaw 318 may be located on the opposite side of first portion 1702 from lower surface 330 of guide plate 326 as shown in FIG. 19. Although shown with lower jaw 318 being located along exterior surface 1718, it should be recognized that customization device 104 may be rotated such that lower jaw 318 may be located along interior surface 1716.

Referring now particularly to FIG. 19, guide plate 326 extends over first portion 1702 such that lower surface 330 of guide plate 326 is adjacent to interior surface 1716 of first portion 1702. Because guide plate 326 is spaced from interior surface 319 of lower jaw 318 by a distance greater than the thickness of first portion 1702, customization device 104 may be able to enter first portion 1702. Additionally, in this configuration, customization device 14 may be able to form apertures in first portion 1702.

In some embodiments, clearance distance 1800 may be less than distance 1708 of first portion 1702. In such embodiments, guide plate 326 may be flexible such that guide plate 326 may be bent or deflected to accommodate the thickness of first portion 1702. In other embodiments, guide plate 326 may be rigidly held in place such that guide plate 326 resists flexing or bending.

Referring now particularly to FIG. 20, customization device 104 is shown abutting second portion 1704. In this embodiment, distance 1710 relating to the thickness of second portion 1704 is greater than clearance distance 1800 between guide plate 326 and lower jaw 318. As shown, guide plate 326 presses into second portion 1704 and is prevented from entering second portion 1704. In this manner, customization device 104 may be prevented from entering second portion 1704, and therefore the thickness of second portion 1704 prevents customization device 104 from forming apertures in second portion 1704.

As shown in FIGS. 17-20, the junction of first portion 1702 and second portion 1704 is a sharp abutment. In other embodiments, the transition from a first portion to a second portion may be gradual. That is, the difference between first portion 1702 and second portion 1704 may not be easily visible or noticeable. In such embodiments, the distance between the interior surface and the exterior surface may gradually increase until the distance is greater than clearance distance 1800 between guide plate 326 and interior surface 319 of lower jaw 318. At this point, the second portion may prevent the customization device from entering the second portion in a similar manner as discussed above.

In some embodiments, various areas of an article may include portions that restrict a customization device from entering the portion or from forming apertures. For example, in some embodiments, a portion restricting customization may be located adjacent to the sole structure. In other embodiments, a portion restricting customization may be located adjacent to lace aperture openings. In further embodiments, a portion restricting customization may be located along the perimeter of the throat opening. Additionally, portions restricting customization may be located in the forefoot region, midfoot region, or heel region or a combination of any of the regions.

Figure 21:
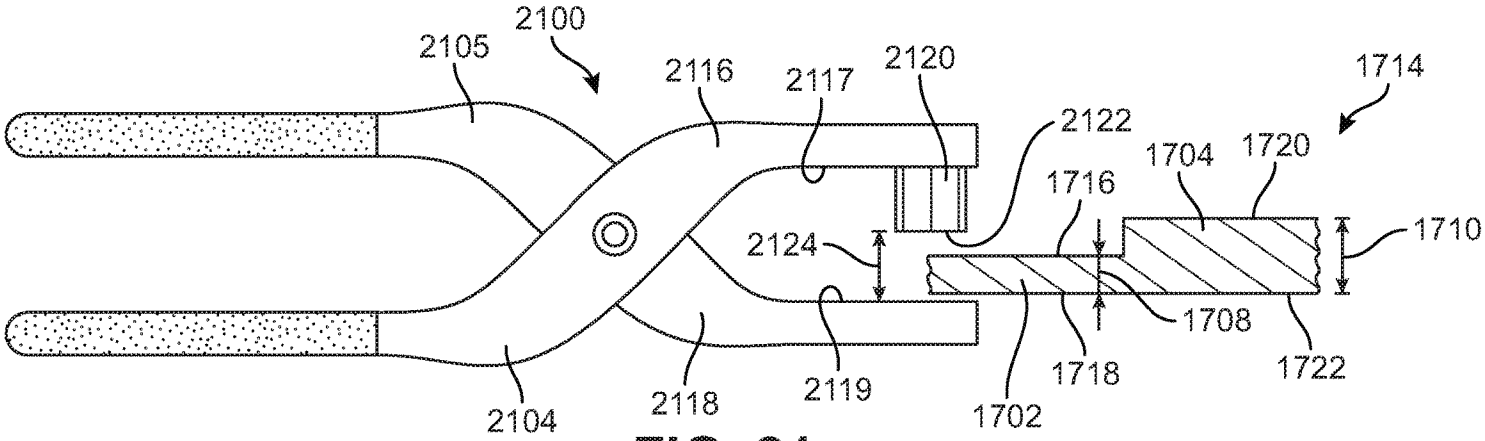
FIGS. 21 and 22 are schematic views of an alternate embodiment of a customization device being used on various portions of an article of footwear.
Figure 22:
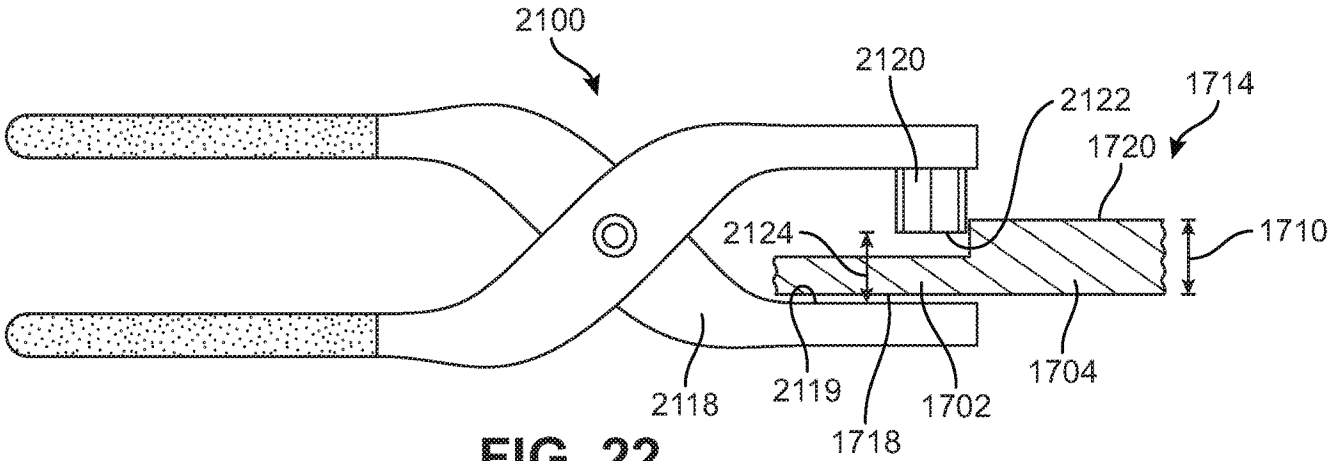

Referring to FIGS. 21 and 22, an alternate embodiment of a customization device is shown in use with cutaway portion 1714. In some embodiments, a customization device may have a different configuration such that the customization device does not include a guide plate. In such embodiments, the spacing of various components of the customization device may be different than the spacing of components of customization device 104. For example, customization device 2100 includes similar components such as lower jaw 2118 of upper handle 2105. Additionally, customization device 2100 includes upper jaw 2116 of lower handle 2104. In a similar configuration to customization device 104, customization device 2100 includes interior surface 2119 of lower jaw 2118 as well as interior surface 2117 of upper jaw 2116. As shown, interior surface 2117 of upper jaw 2116 may face interior surface 2119 of lower jaw 2118. Further, customization device 2100 includes a shape-defining portion such as punch 2120 of customization device 2100. Punch 2120 may be used to form an opening, aperture, or hole in a material. Punch 2120 may be pressed into a material and cut the material such that a hole is formed in the material that corresponds in shape and size to the shape and size of the shape of punch 2120. For example, punch surface 2122 is in a tri-star shape. Therefore, when punch 2120 is pressed against a material and cuts a material, the shape of the aperture formed by punch 2120 may correspond to the shape and size of punch surface 2122.

In some embodiments, portions of customization device 2100 may be particularly spaced. For example, punch surface 2122 may be spaced from interior surface 2119 of lower jaw 2118 by clearance distance 2124. In this configuration, clearance distance 2124 may represent the maximum distance that interior surface 2119 may be located away from punch surface 2122. That is, without bending or breaking customization device 2100, when open, interior surface 2119 may be spaced clearance distance 2124 away from punch surface 2122.

In some embodiments, the distance that the punch surface is positioned relative to the interior surface of a lower jaw may correspond to various portions of an article of footwear. For example, in some embodiments, clearance distance 2124 may be greater than the thickness of first portion 1702. That is, clearance distance 2124 may be greater than distance 1708 of first portion 1702. Therefore, customization device 2100 may enter first portion 1702 because there is adequate space for punch surface 2122 and interior surface 2119 of lower jaw 2118 to be located on either side of first portion 1702. For example, interior surface 2119 of lower jaw 2118 may be able to be located adjacent to exterior surface 1718 of first portion 1702 while punch surface 2122 is located on the opposite side of interior surface 2119 and adjacent to interior surface 1716 of first portion 1702.

Referring now particularly to FIG. 22, customization device 2100 is shown at a different location along cutaway portion 1714. As shown, punch 2120 may abut the side surface of second portion 1704. That is, second portion 1704 may prevent customization device 2100 from entering second portion 1704. In some embodiments, the thickness of second portion 1704 may prevent customization device 2100 from entering second portion 1704. For example, distance 1710 that relates to the thickness of second portion 1704 may be greater than clearance distance 2124 between interior surface 2119 of lower jaw 2118 and punch surface 2122. Therefore, second portion 1704 may prevent customization device 2100 from being positioned in second portion 1704.

Figure 23:
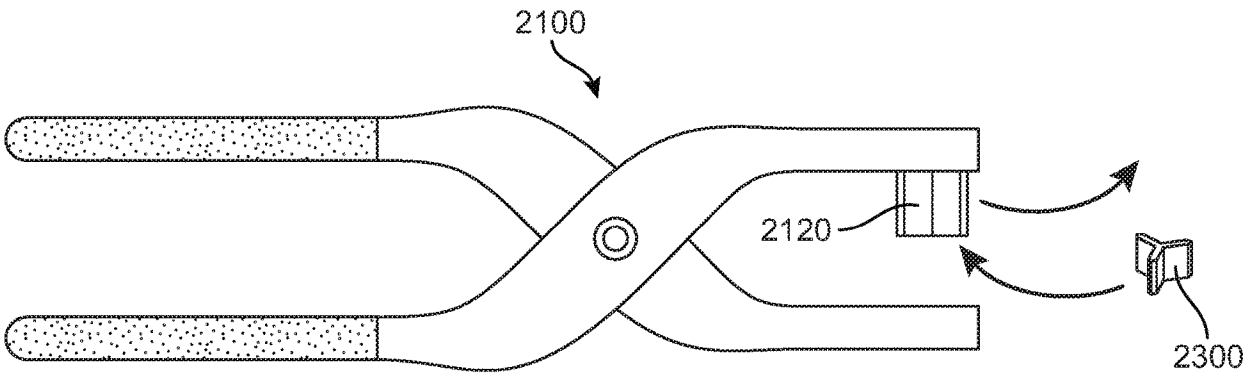
FIGS. 23 and 24 are schematic views of an embodiment of a customization device that includes a removable punch.
Figure 24:
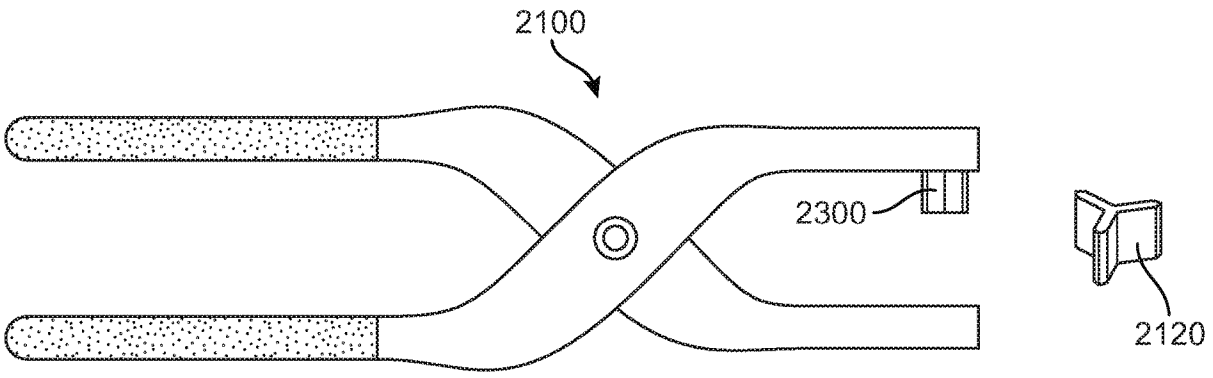

Referring now to FIGS. 23 and 24, in some embodiments, a customization device may include various punches. In some embodiments, the punches may be removable and interchangeable with other punches. For example, customization device 2100 may include punch 2120 that has a tri-star shape as discussed previously. Additionally, punch

2120 may be any size. In some embodiments, a different-sized punch, for example, second punch 2300 may be desired to form different-sized apertures in an article of footwear. As shown in FIGS. 23 and 24, punch 2120 may be removed from customization device 2100 and replaced with second punch 2300. The punches may be removed and replaced by any means known in the industry and not limited to threaded punches.

While various embodiments have been described, the description is intended to be exemplary, rather than limiting, and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

What is claimed is:

1. A kit of parts for enabling an end user of an article of footwear to customize a fit of the article of footwear, the kit including:

the article of footwear including an upper attached to a sole structure;

wherein the upper includes a first portion and a second portion;

the first portion having a first interior surface and an opposite first exterior surface;

the first portion having a first thickness between the first interior surface and the opposite first exterior surface;

the second portion having a second interior surface and an opposite second exterior surface;

the second portion having a second thickness between the second interior surface and the opposite second exterior surface;

a customization device configured to form an aperture in the article of footwear;

the customization device having a punch, a guide surface having a punch aperture formed therein, and an interior surface;

the guide surface being spaced from the interior surface by a clearance distance;

wherein the clearance distance is larger than the first thickness thereby permitting the first portion of the article of footwear to extend between the guide surface and the interior surface;

wherein the clearance distance of the customization device is smaller than the second thickness of the article of footwear, thereby preventing the second portion from extending between the guide surface and the interior surface; and wherein the punch is operative to pass through the first portion and through the punch aperture in the guide surface to form the aperture in the first portion of the article of footwear, and wherein the formation of the aperture in the first portion of the article of footwear alters the fit or stretch of the first portion.

2. The kit of parts according to claim 1, wherein the punch aperture of the guide surface and the punch have a tri-star shape operative to form an auxetic aperture in the first portion of the article of footwear.

3. The kit of parts according to claim 1, wherein the aperture of the guide surface is substantially similar in shape to the shape of the punch.

4. The kit of parts according to claim 1, wherein the first portion comprises a fusible material.

5. The kit of parts according to claim 1, wherein the first portion is formed of a first material and the second portion is formed of a second material, the first material being more elastic than the second material.

6. A kit of parts for enabling an end user of an article of footwear to customize a fit of the article, the kit including:

the article of footwear including an upper attached to a sole structure;

wherein the upper includes a first portion and a second portion;

the first portion having a first interior surface and an opposite first exterior surface;

the first portion having a first thickness between the first interior surface and the opposite first exterior surface;

the second portion having a second interior surface and an opposite second exterior surface;

the second portion having a second thickness between the second interior surface and the opposite second exterior surface;

a customization device configured to form an aperture in the article of footwear;

the customization device having a punch and a lower unit; the punch including a punch surface;

the lower unit including an interior surface;

the punch surface being spaced from the interior surface by a clearance distance;

wherein the clearance distance is larger than the first thickness thereby permitting the punch surface and the interior surface to enter the first portion; and wherein the clearance distance is smaller than the second thickness thereby preventing the punch surface and the interior surface from entering the second portion.

7. The kit of parts according to claim 6, wherein the punch is removable from the customization device.

8. The kit of parts according to claim 7, wherein the kit of parts further includes a second punch, the second punch being a different size than the punch.

9. The kit of parts according to claim 6, wherein the second portion is located in a forefoot region of the article of footwear.

10. The kit of parts according to claim 6, wherein the first portion comprises a fusible material.

* * * * *